US012588702B2

(12) United States Patent
Martin et al.

(10) Patent No.: US 12,588,702 B2
(45) Date of Patent: Mar. 31, 2026

(54) NICOTINE POUCH DISPENSER

(71) Applicant: Pouch Mag, LLC, Halethorpe, MD (US)

(72) Inventors: Sean Martin, Halethorpe, MD (US); Andrew Bilich, Babylon, NY (US)

(73) Assignee: Pouch Mag, LLC, Halethorpe, MD (US)

( * ) Notice: Subject to any disclaimer, the term of this patent is extended or adjusted under 35 U.S.C. 154(b) by 0 days.

(21) Appl. No.: 19/332,699

(22) Filed: Sep. 18, 2025

(65) Prior Publication Data

US 2026/0013551 A1 Jan. 15, 2026

Related U.S. Application Data

(63) Continuation of application No. 19/097,221, filed on Apr. 1, 2025, which is a continuation-in-part of application No. 18/989,783, filed on Dec. 20, 2024.

(60) Provisional application No. 63/549,221, filed on Feb. 2, 2024.

(51) Int. Cl.

| | |
|---|---|
| ***A24F 23/00*** | (2006.01) |
| ***A24B 13/00*** | (2006.01) |
| ***A45F 5/02*** | (2006.01) |
| ***B65D 83/04*** | (2006.01) |

(52) U.S. Cl.

CPC ..... *A24F 23/00* (2013.01); *A24B 13/00* (2013.01); *A45F 5/021* (2013.01); *B65D 83/04* (2013.01)

(58) Field of Classification Search

CPC ..... B65D 83/0418; B65D 83/0409; B65D 83/04; A24F 23/00; A24B 13/00; A45F 5/021

See application file for complete search history.

(56) References Cited

U.S. PATENT DOCUMENTS

| | | | | | |
|---|---|---|---|---|---|
| 1,408,464 | A | | 3/1922 | Moeller | |
| 2,519,438 | A | | 8/1950 | Conley | |
| 2,620,061 | A | | 12/1952 | Uxa | |
| 2,887,248 | A | | 5/1959 | Woodson, Sr. | |
| 3,410,455 | A | | 11/1968 | Eduard | |
| 3,845,882 | A | | 11/1974 | Hass | |
| 3,942,683 | A | | 3/1976 | Haas | |
| 4,966,305 | A | | 10/1990 | Hinterreiter | |
| 4,986,442 | A | * | 1/1991 | Hinterreiter | B65D 83/0418 221/229 |
| 5,071,033 | A | * | 12/1991 | Siwek | B65D 83/0409 221/229 |
| 5,118,007 | A | * | 6/1992 | Lewis | B65D 83/049 206/536 |
| 11,059,662 | B2 | | 7/2021 | Marchitto et al. | |

(Continued)

*Primary Examiner* — Timothy R Waggoner
(74) *Attorney, Agent, or Firm* — NEO IP

(57) ABSTRACT

A spring-loaded nicotine pouch dispenser which enables users to access nicotine pouches quickly and easily. The nicotine pouch dispenser utilizes a dual-spring setup working in tandem underneath a plate to support the pouches and press them up to the body towards the opening. The retention prongs and semicircular cutout at the opening keep the pouches inline and secure from falling out while still being easy to access. The entire mechanism is encased in an outer body shell and a flip cap resulting in a completely sealed waterproof design that allows for easy, one-handed operation, eliminating the need for great strength or dexterity.

20 Claims, 35 Drawing Sheets

(56) References Cited

U.S. PATENT DOCUMENTS

| | | | | |
|---|---|---|---|---|
| 12,288,439 | B1 * | 4/2025 | Steinbauer | G06Q 20/18 |
| 2007/0131704 | A1 | 6/2007 | Ahedo et al. | |
| 2007/0248656 | A1 * | 10/2007 | Galer | A61K 31/7048 514/35 |
| 2010/0294791 | A1 * | 11/2010 | Weibel | B65D 83/0409 221/154 |
| 2012/0024881 | A1 | 2/2012 | Papaloizou et al. | |
| 2014/0069829 | A1 * | 3/2014 | Evans | A24F 23/02 206/265 |
| 2014/0339249 | A1 * | 11/2014 | Reddy | G16H 20/13 221/1 |
| 2021/0403225 | A1 * | 12/2021 | Koh | B65D 83/0418 |
| 2024/0156156 | A1 | 5/2024 | Felix | |

* cited by examiner

NICOTINE POUCH DISPENSER

CROSS REFERENCES TO RELATED APPLICATIONS

This application is related to and claims priority from the following U.S. Patent Applications: this application is a continuation of U.S. patent application Ser. No. 19/097,221 filed Apr. 1, 2025, which is a continuation-in-part of U.S. patent application Ser. No. 18/989,783 filed Dec. 20, 2024, which claims priority to and the benefit of U.S. Provisional Patent Application No. 63/549,221, filed Feb. 2, 2024, each of which is incorporated herein by reference in its entirety.

BACKGROUND OF THE INVENTION

1. Field of the Invention

The present invention relates to nicotine pouch dispensers, and more specifically to spring-loaded nicotine pouch dispensers.

2. Description of the Prior Art

It is generally known in the prior art to provide a spring-loaded dispenser of candy or cigarettes.

Prior art patent documents include the following:

US Patent Pub. No. 2012/0024881 for Smoking Article Dispenser by inventors Papaloizou et al., filed on Dec. 23, 2009, and issued on Feb. 2, 2012, discloses a smoking article dispenser. The dispenser housing is designed to receive a cartridge of smoking articles. The interior of the dispenser housing is configured with elements to dispense a smoking article when the cartridge is actuated between a first and second position. Additionally, the patent covers a cartridge for use with such a dispenser, the combination of such a dispenser with a cartridge, and a method of operating such a dispenser.

US Patent Pub. No. 2007/0131704 for Cigarette Dispenser by inventors Ahedo et al., filed on Nov. 17, 2006, and issued on Jun. 14, 2007, describes a cigarette dispenser that comprises a compartment where cigarettes are stored, an opening through which the cigarettes facing said opening are provided, a lid which covers the opening and which is attached to the dispenser by means of a rotation shaft, and actuating means that comprise an actuator which is displaced when it is operated. Said displacement causes the lid to pivot in relation to said rotation shaft revealing said opening, being possible to provide the cigarettes through said opening. When the actuator is displaced in a longitudinal direction, said actuating means are longitudinally displaced and draw a cigarette, such that said cigarette is provided through said opening.

U.S. Pat. No. 4,966,305 for Tablet Dispenser by inventor Ignaz, filed on Sep. 6, 1988, and issued on Oct. 30, 1990, describes a tablet dispenser with a sleeve and a magazine for holding the tablet stack. The magazine is guided in the sleeve and has an essentially U-shaped cross-section and a base connecting the limbs. For filling purposes, the magazine can be pushed partially out of the sleeve against the force of a spring arranged between the base of the magazine and a cup-like slide that is displaceable in the magazine and in the sleeve and acts as a plate spring. The slide is guided in the magazine to prevent complete tilting in the magazine and is provided with lateral projections, one of which passes through a slot arranged in the web of the magazine and engages a groove running in the longitudinal direction of the sleeve and the other of which engages a further longitudinal groove of the sleeve, which longitudinal grooves are at least partially closed at the push-out end of the sleeve and form stops for the projections of the slide. The projection of the slide that passes through the slot of the magazine is provided with a hammer-head, and a pin stop is arranged close to the base of the magazine, on the latter, and engages between two coils of the spring. U.S. Pat. No. 4,120,423 for Cigarette Dispenser by inventor Fruhwirth, filed on Jun. 9, 1977, and issued on Oct. 17, 1978, discloses a cigarette dispenser with a casing having dispensing means movable to dispense a cigarette through a dispensing opening. Slide means and cam means associated with the slide means ensure sequential movements, activating the dispensing means one at a time and in sequence.

U.S. Pat. No. 3,942,683 for Tablet Dispensing Receptacle by inventor Haas, filed on Sep. 16, 1974, and issued on Mar. 9, 1976, discloses a tablet dispensing receptacle whose housing carries a spring-biased cover designed to dispense an uppermost tablet from the housing upon pivoting, the spring bias for the cover is provided by an elastically deformable transverse ledge extending between side wall extensions of the housing in a horizontal plane and integral with the side wall extensions and a bent-over spring leaf integrally projecting from the ledge so that the ledge and leaf spring constitute a spring. The outer end of the bent-over leaf spring engages an abutment of the cover for pushing the uppermost tablet and dispensing it from the receptacle housing when the cover is pivoted about its pivoting axis against the spring bias which normally holds the cover in closed position. The pivoting axis extends below the horizontal plane defined by the ledge.

U.S. Pat. No. 3,845,882 for Spring Cage for Use in a Tablet Dispensing Receptacle by inventor Hass, filed on Oct. 25, 1972, and issued on Nov. 5, 1974, discloses a spring cage for use in a receptacle for receiving and sequentially dispensing individual shaped bodies from a stack received in a receptacle housing having a dispensing end. The cage comprises a structural unit consisting of a spring abutment, a support bottom for carrying the stack of shaped bodies, and a compression spring held between the abutment and support bottom. The abutment and support bottom are releasably interlocked for insertion as a unit into the receptacle housing. The compression spring presses the stack of shaped bodies towards the dispensing end to place sequential uppermost shaped bodies of the stack into a dispensing position when the unit has been inserted and the interlocking of the abutment and the support bottom has been released.

U.S. Pat. No. 3,410,455 for Dispensing Device for Tablets by inventor Haas, filed on Dec. 13, 1966, and issued on Nov. 12, 1968, discloses a dispensing device for tablets of longitudinal shape, particularly of prismatic configuration, comprising a housing adapted to receive a plurality of tablets in the form of a pile, the tablets constituting a first member, the housing having a bottom and an intermediate bottom disposed in the housing intermediate its open upper end and the bottom, spring means disposed between the intermediate bottom and the bottom of the housing and urging the intermediate bottom to its uppermost position, and the housing defining a tablet receiving range and in its upper position a dispensing range adapted to dispense the uppermost of the pile of tablets disposed substantially in the tablet receiving range. A cover member is provided suitably mounted on top of the housing and the cover includes the sliding-out member entering the dispensing range upon swinging the cover member from its housing closing position to its open position. The dispensing range of the housing is defined by at least three walls, constituting second members and dispensing laterally the uppermost of the tablets in the direction perpendicular to the direction of movement of the tablets in the pile and at least one of the members has at least one projection extending into the dispensing range of the projection and is adapted to be received by a complementary recess of the other of the members, so that having no recesses cannot be dispensed by the device.

U.S. Pat. No. 2,887,248 for Cigarette Dispensing Pocket Case by inventor Woodson Sr., filed on Nov. 14, 1955, and issued on May 19, 1959, discloses a cigarette dispensing pocket case or, more particularly, a cigarette case which can readily be carried about in the pocket of the user and from which single cigarettes can be mechanically ejected.

U.S. Pat. No. 2,620,061 for Pocket Article Dispensing Container by inventor Uxa, filed on Oct. 14, 1949, and issued on Dec. 2, 1952, discloses pocket containers having, a hinged lid and adapted for the delivery of articles. such for example as pastilles, tablets, sweetmeats and cigarettes, which containers, can be opened or closed with one hand, and present the merchandise to the user in a hygienic and unspoilt condition. The possibility of operation by one hand only is important not only for persons having only one hand but also persons, who often, have only one hand free (for example motor-vehicle drivers), or whose occupation causes their hands to become smeared with dirt.

U.S. Pat. No. 2,519,438 for Cigarette Container and Dispenser by inventor Conley, filed on Feb. 20, 1948, and issued on Aug. 22, 1950, discloses a simply constructed and compact dispenser which has a minimum of moving parts which can be operated in a very simple manner to effectively dispense cigarettes therefrom.

U.S. Pat. No. 1,408,464 for Cigarette Case by inventor Moeller, filed on Feb. 15, 1920, and issued on Mar. 7, 1922, discloses cigarette cases of that type wherein a row of cigarettes disposed side by side within the case Is subjected laterally to the pressure of a spring actuated follower, and the foremost cigarette of: the row is partially ejected endwise through a delivery opening in one side wall of the case by means of a sliding ejector, the next cigarette of the row automatically taking its place as soon as the foremost cigarette is withdrawn.

US Patent Pub. No. 2024/0156156 for Cigarette, lighter storage and cigarette butt storage and disposal device by inventor Felix, filed on Nov. 10, 2022, and published on May 16, 2024, discloses a cigarette storage and disposal device that is configured to be releasably secured to a user's belt or similar support element wherein the present invention is operable to provide storage of cigarettes, a lighter and further provide a compartment to receive and store cigarette butts subsequent consumption of a cigarette. The device includes a housing wherein the housing is divided into a first compartment, a second compartment and a third compartment. The first compartment is configured to receive, store and provide access to a cigarette lighter. The second compartment is operable to receive and retain cigarette butts for storage. The third compartment of the present invention includes is configured to receive, store and dispense cigarettes. The third compartment includes a track member having a cigarette movement member operably disposed therein. A belt clip member is present and is operable to secure the housing to a belt or similar object.

U.S. Pat. No. 11,059,662 for Rigid package with a hinged lid and with an inner container connected to the front wall of the lid by inventors Marchitto, et al., filed on Jan. 23, 2018, and issued on Jul. 14, 2021, discloses a rigid package for tobacco articles with a hinged lid having: a group of tobacco articles; an inner container which houses the group of tobacco articles; an outer container which houses the inner container in a movable manner, so as to allow the inner container to move relative to the outer container; a hinged lid; and a moving mechanism, which moves the inner container relative to the outer container using the rotation movement of the lid and has a rigid connection tab, which connects a wall of the inner container to a wall of the lid.

SUMMARY OF THE INVENTION

The present invention relates to nicotine pouch dispensers, and more specifically to spring-loaded nicotine pouch dispensers.

It is an object of this invention to provide an efficient means of dispensing nicotine pouches.

In one embodiment, the present invention includes a spring-loaded nicotine pouch dispenser including a body including an upper body section and a lower body section, wherein the upper body section includes a cutout on a top face of the upper body section, wherein the cutout includes at least one retention prong, wherein the lower body section includes at least one hinge, a plate installed below the cutout and the at least one retention prong, a cap attached to the body by the at least one hinge and a pin, a bottom seal attached to a bottom end of the body, at least one cylindrical extension protruding from the plate, at least one spring mounted between the bottom seal and the plate and positioned around the at least one cylindrical extension, and wherein the spring-loaded nicotine pouch dispenser is operable to store a nicotine pouch and further operable to dispense the nicotine pouch.

In another embodiment, the present invention includes a system for dispensing nicotine pouches including a spring-loaded nicotine pouch dispenser, including, a body including an upper body section and a lower body section, wherein the upper body section includes a cutout on a top face of the upper body section, wherein the cutout includes at least one retention prong, wherein the lower body section includes at least one hinge, a plate installed below the cutout and the at least one retention prong, a cap attached to the body by the at least one hinge and a pin, a bottom seal attached to a bottom end of the body, at least one cylindrical extension protruding from the plate, at least one spring mounted between the bottom seal and the plate and positioned around the at least one cylindrical extension, at least one nicotine pouch inserted on top of the plate and below the at least one retention prong, and wherein the spring-loaded nicotine pouch is operable to dispense at least one nicotine pouch.

In a further embodiment, the present invention includes a spring-loaded nicotine pouch dispenser, including a body including an upper body section and a lower body section, wherein the upper body section includes a cutout on a top face of the upper body section, wherein the cutout includes at least one retention prong, wherein the lower body section includes at least one hinge, a plate installed below the cutout and the at least one retention prong, a cap attached to the body by the at least one hinge and a pin, wherein the cap includes a lip protruding from a body of the cap, a bottom seal attached to a bottom end of the body, at least one cylindrical extension protruding from the plate, at least one spring mounted between the bottom seal and the plate and positioned around the at least one cylindrical extension, and wherein the spring-loaded nicotine pouch dispenser is operable to store a nicotine pouch and further operable to dispense the nicotine pouch.

These and other aspects of the present invention will become apparent to those skilled in the art after a reading of the following description of the preferred embodiment when considered with the drawings, as they support the claimed invention.

DETAILED DESCRIPTION

Figure 1:
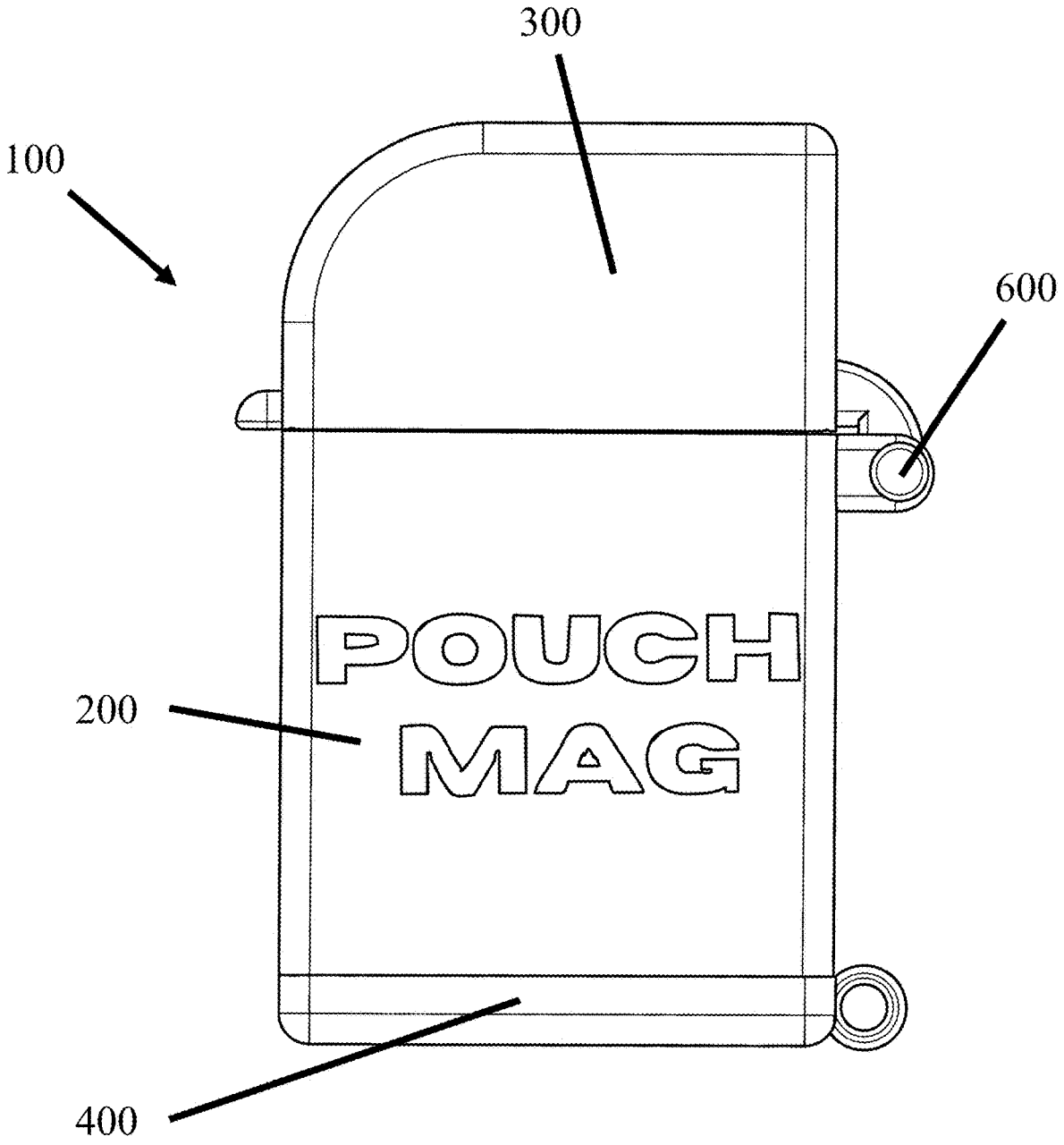
FIG. 1 illustrates a side view of the nicotine pouch dispenser fully assembled.

The present invention relates to nicotine pouch dispensers, and more specifically to spring-loaded nicotine pouch dispensers.

In one embodiment, the present invention includes a spring-loaded nicotine pouch dispenser including a body including an upper body section and a lower body section, wherein the upper body section includes a cutout on a top face of the upper body section, wherein the cutout includes at least one retention prong, wherein the lower body section includes at least one hinge, a plate installed below the cutout and the at least one retention prong, a cap attached to the body by the at least one hinge and a pin, a bottom seal attached to a bottom end of the body, at least one cylindrical extension protruding from the plate, at least one spring mounted between the bottom seal and the plate and positioned around the at least one cylindrical extension, and wherein the spring-loaded nicotine pouch dispenser is operable to store a nicotine pouch and further operable to dispense the nicotine pouch, wherein the bottom seal is attached to the body through welding, plastic welding, adhesives, screws, latches, or other permanent or semi-permanent joining process, wherein at least one second hinge is mounted on a backside of the lower body section, wherein the spring-loaded nicotine pouch dispenser further includes at least one gasket, wherein the spring-loaded nicotine pouch dispenser is formed of materials including plastic, metal, and/or fiber-reinforced composite, wherein the cap includes a lip protruding from a body of the cap, wherein the bottom seal includes at least one additional cylindrical extension, wherein the at least one additional cylindrical extension retains the at least one spring on the bottom seal, wherein the spring-loaded nicotine pouch dispenser is formed by injection molding.

In another embodiment, the present invention includes a system for dispensing nicotine pouches including a spring-loaded nicotine pouch dispenser, including, a body including an upper body section and a lower body section, wherein the upper body section includes a cutout on a top face of the upper body section, wherein the cutout includes at least one retention prong, wherein the lower body section includes at least one hinge, a plate installed below the cutout and the at least one retention prong, a cap attached to the body by the at least one hinge and a pin, a bottom seal attached to a bottom end of the body, at least one cylindrical extension protruding from the plate, at least one spring mounted between the bottom seal and the plate and positioned around the at least one cylindrical extension, at least one nicotine pouch inserted on top of the plate and below the at least one retention prong, and wherein the spring-loaded nicotine pouch is operable to dispense at least one nicotine pouch, wherein the bottom seal is attached to the body through welding, plastic welding, adhesives, screws, latches, or other permanent or semi-permanent joining process., wherein at least one second hinge is mounted on a backside of the lower body section, wherein the spring-loaded nicotine pouch dispenser further includes at least one gasket, wherein the spring-loaded nicotine pouch dispenser is formed of materials including plastic, metal, and/or fiber-reinforced composite, wherein the cap includes a lip protruding from a body of the cap, wherein the bottom seal includes at least one additional cylindrical extension, wherein the at least one additional cylindrical extension is operable to retain the at least one spring, wherein the spring-loaded nicotine pouch dispenser is formed by injection molding.

In a further embodiment, the present invention includes a spring-loaded nicotine pouch dispenser, including a body including an upper body section and a lower body section, wherein the upper body section includes a cutout on a top face of the upper body section, wherein the cutout includes at least one retention prong, wherein the lower body section includes at least one hinge, a plate installed below the cutout and the at least one retention prong, a cap attached to the body by the at least one hinge and a pin, wherein the cap includes a lip protruding from a body of the cap, a bottom seal attached to a bottom end of the body, at least one cylindrical extension protruding from the plate, at least one spring mounted between the bottom seal and the plate and positioned around the at least one cylindrical extension, and wherein the spring-loaded nicotine pouch dispenser is operable to store a nicotine pouch and further operable to dispense the nicotine pouch, wherein the spring-loaded nicotine pouch dispenser further includes at least one gasket, wherein the bottom seal includes at least one additional cylindrical extension, wherein the at least one additional cylindrical extension retains the at least one spring on the bottom seal, wherein the spring-loaded nicotine pouch dispenser is formed of materials including plastic, metal, and/or fiber-reinforced composite.

None of the prior art discloses spring-loaded nicotine pouch dispensers.

As the demand for smokeless tobacco alternatives continues to rise, nicotine pouches have emerged as a popular choice for individuals seeking a convenient and discreet way to satisfy nicotine cravings without the need for traditional methods of ingesting nicotine, such as smoking or vaping. Despite the growing popularity of these pouches, the existing dispensing methods often present challenges in terms of accessibility, efficiency, and user-friendliness.

While devices that hold and dispense items using a spring-loaded mechanism are well known, these devices are not designed to hold or dispense nicotine pouches. Other devices such as those described in U.S. Pat. No. 2,519,438 are designed to hold cigarettes. U.S. Pat. No. 2,620,061 describes a device designed to hold and dispense pastilles, tablets, sweetmeats, and cigarettes. However, neither of these devices is suitable for holding or dispensing nicotine pouches in a manner which provides for the pouches to be dispensed easily, quickly, and without damage to the pouches.

Current nicotine pouch cans and holders often require manual opening and extraction, which is cumbersome and inconvenient, especially in situations that demand swift and discreet access. Additionally, the risk of misplacement or damage to individual pouches during manual retrieval poses a notable drawback for users.

Recognizing these challenges and aiming to contribute to smoking cessation efforts, there is a long felt, unmet need for a nicotine pouch dispenser that enhances the user experience, thereby helping an individual in their journey towards quitting smoking or consumption of nicotine in other, less healthy formats. The dispenser leverages a spring-loaded mechanism to enable rapid and effortless deployment of nicotine pouches. Through this design, this dispenser aims to redefine industry standards, offering users a tool that not only satisfies their nicotine cravings efficiently and quickly, but which also aligns with broader public health goals of reducing the prevalence of traditional smoking and vaping.

Referring now to the drawings in general, the illustrations are for the purpose of describing one or more preferred embodiments of the invention and are not intended to limit the invention thereto.

Figure 2:
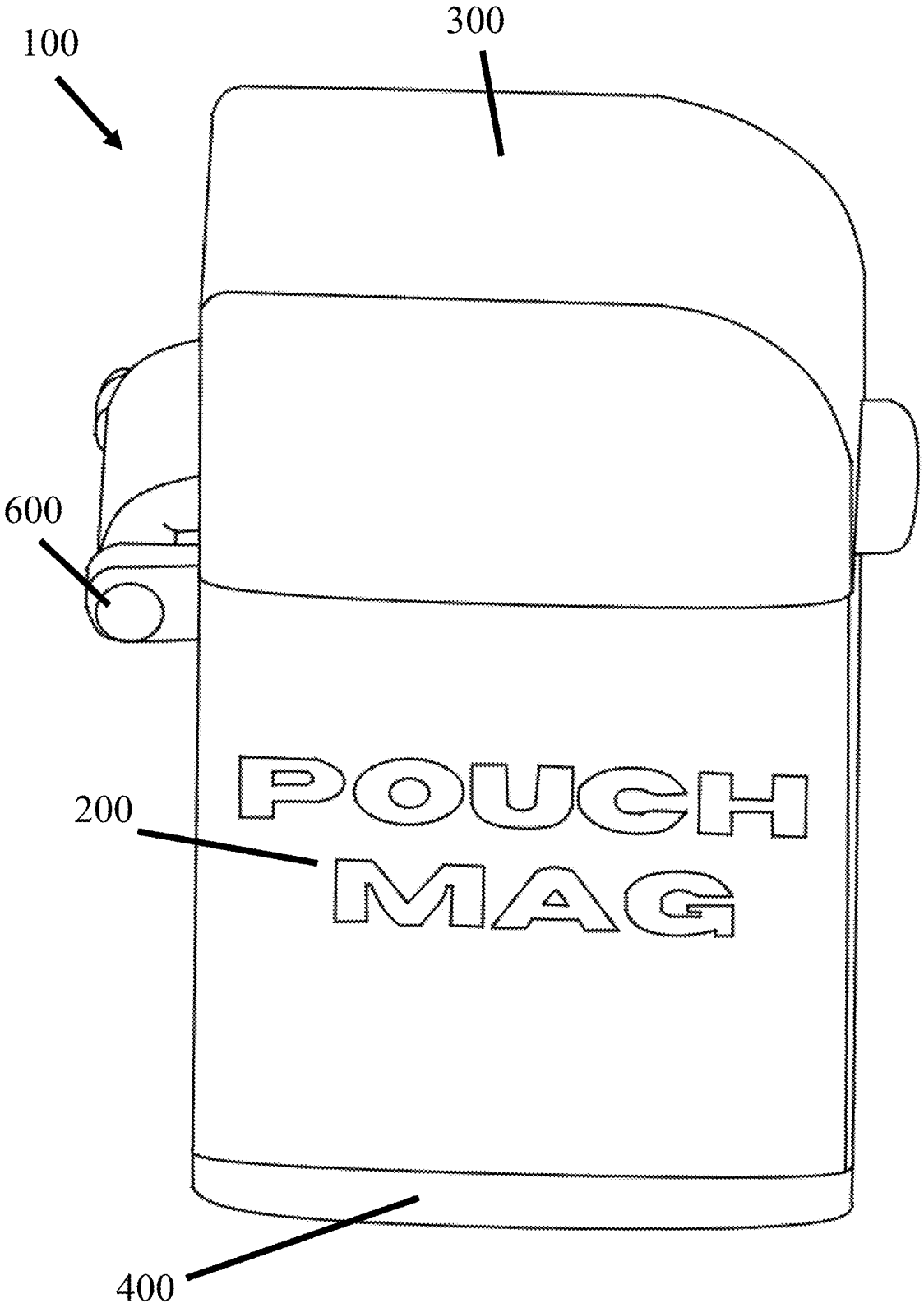
FIG. 2 illustrates a perspective view of the nicotine pouch dispenser fully assembled.

FIGS. 1 and 2 illustrate a side and perspective views of the nicotine pouch dispenser 100, fully assembled, respectively. In one embodiment, the nicotine pouch dispenser 100 outer shell is comprised of four main components, the body 200, the cap 300, the bottom seal 400, and the pin 600. The body 100 and cap 300 are attached with the pin 600 allowing for the cap 300 to rotate off and onto the top of the body 200.

In one embodiment, the bottom seal 400 is attached to the body 200 through welding, plastic welding, adhesive, screws, latches, or other permanent or semi-permanent joining processes. This use of a separate body 200 and a bottom seal 400 parts and attachment at a later time allows for the easy installation and assembly of the internal spring parts before the attachment of the two parts. The use of a screw or latch allows the user to disassemble and alter or service the nicotine pouch dispenser 100. In another embodiment, the body 200 and cap 400 are integrally formed as one piece to reduce the assembly process and number of pieces. The internal spring mechanism is installed from the top side of the body 200. In one embodiment the nicotine pouch dispenser 100 is made of a waterproof material able to withstand IP67 standards and the seal between the body 200 and cap 300 is also waterproof and able to withstand IP 67 standards. In one embodiment, a gasket is used to seal the connection between the body 200 and cap 300 to prevent any liquid from entering the nicotine pouch dispenser and ruining the nicotine pouches.

Figure 3:
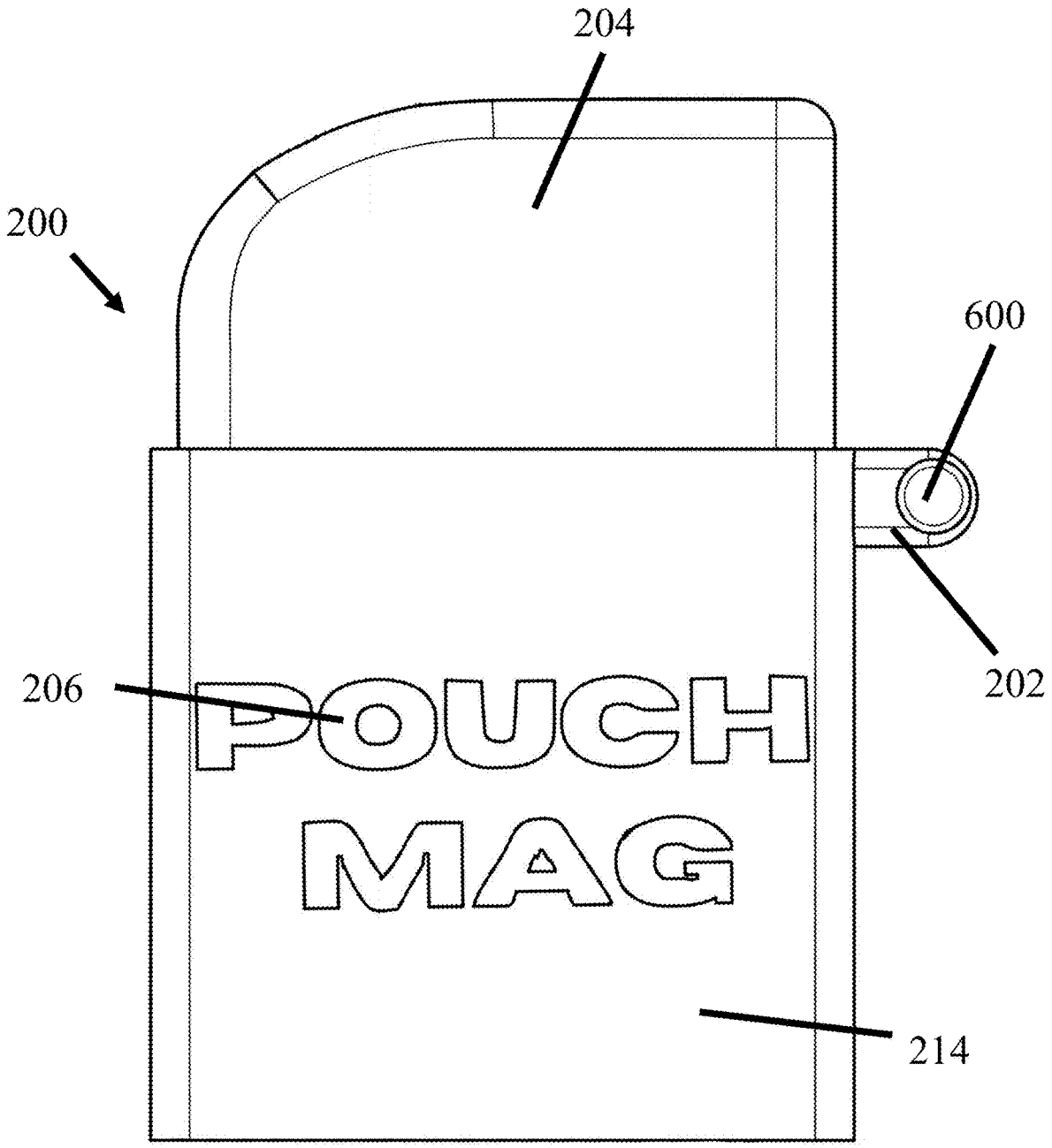
FIG. 3 illustrates a side view of the body of the nicotine pouch dispenser.
Figure 4:
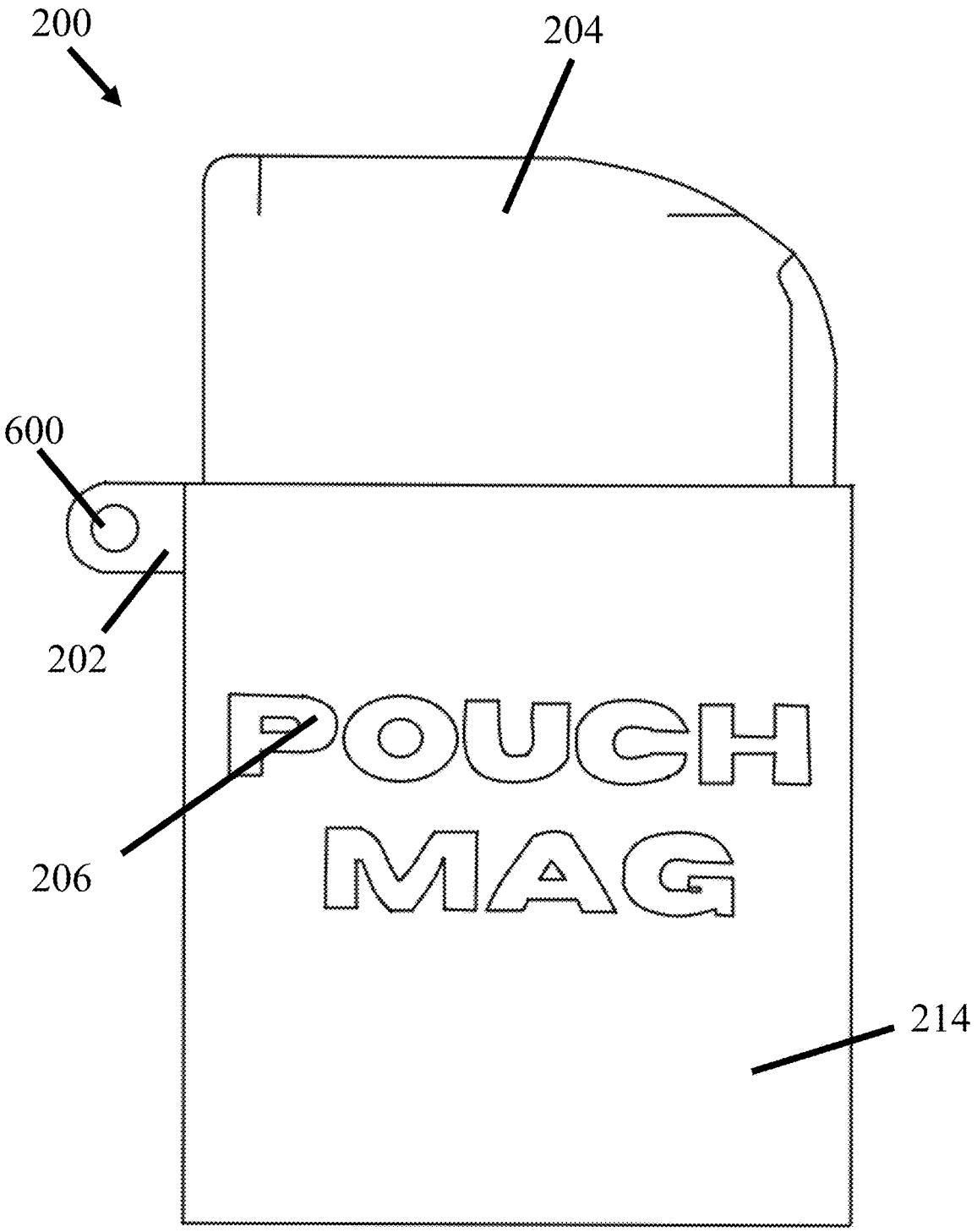
FIG. 4 illustrates a second side view of the body of the nicotine pouch dispenser.
Figure 5:
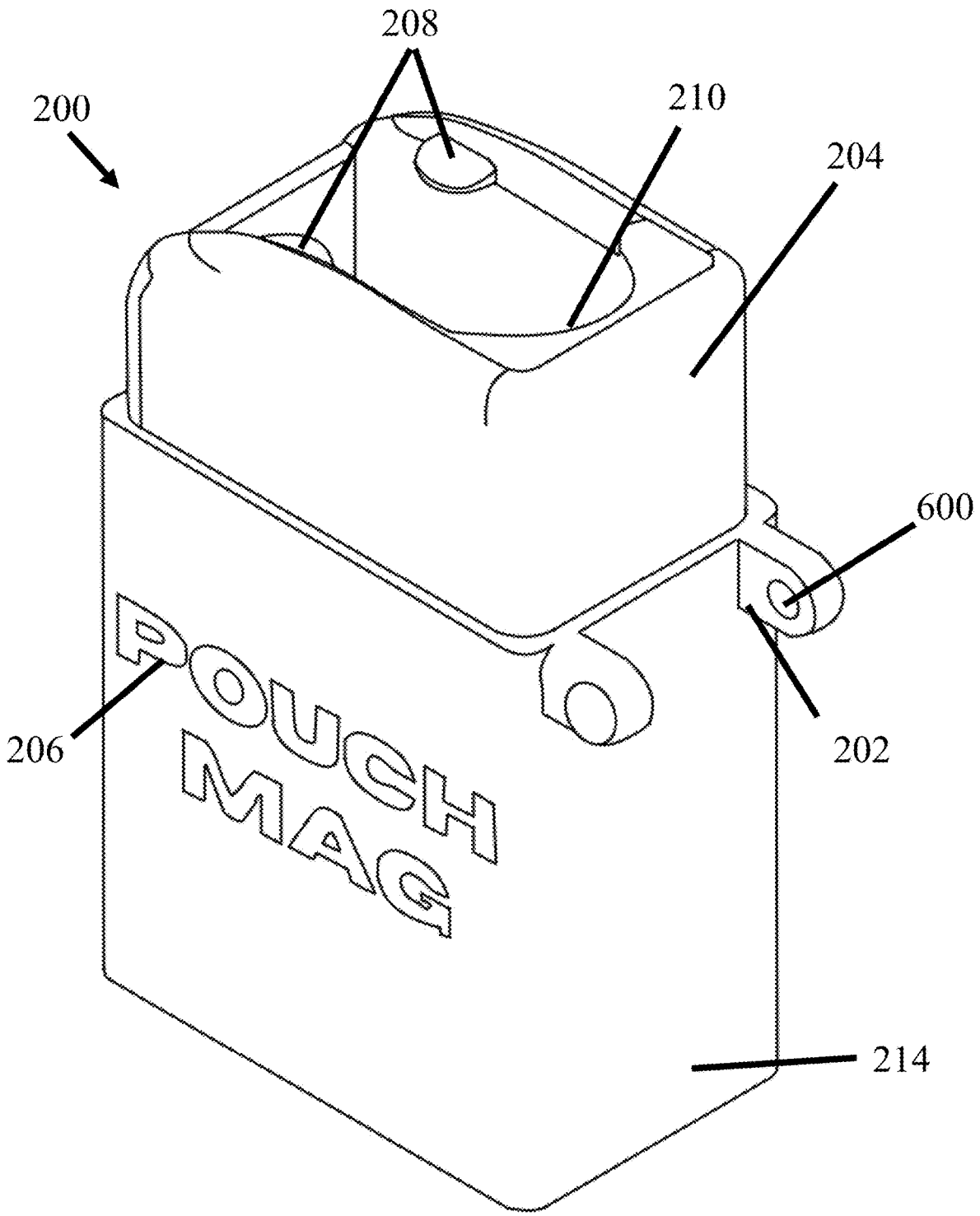
FIG. 5 illustrates a perspective view of the body of the nicotine pouch dispenser.

FIGS. 3 and 4 illustrate side views of the nicotine pouch dispenser body 200 with the pin 600. FIG. 5 illustrates a perspective view of the body 200 of the nicotine pouch dispenser. In one embodiment, the nicotine pouch dispenser is mostly made up of the body 200, which has a lower body section 214 that is the shape of a rectangular prism with filleted or chamfered edges so that it is smooth to the touch of a user. This design also reduces the likelihood of the dispenser getting caught in a pocket or on fabric. In one embodiment, the side of the lower body section 214 includes a logo 206. One of ordinary skill in the art will understand that the logo is operable to be almost any design, wording, or pattern including but not limited to, sports team logos, flags, sayings, emojis, animals, brand logos, numbers, and/or artwork.

In one embodiment, the backside face of the lower body section 214 includes body hinges 202 mounted at the top, so that the tops of the body hinges 202 are substantially flush and parallel with the top edge of the lower body section. The eye holes of the body hinges 202 are substantially horizontal so that the pin 600 slides through into place horizontally or substantially horizontally. In one embodiment, the pin 600 slides into place and is set with adhesive, an interference fit, welding, plastic welding, and/or any other suitable affixation method.

In one embodiment, the dispenser includes an upper body section 204 of the body 200 attached to the lower body section 214. The upper body section 204 is the general shape of a rectangular prism with filleted edges with the top smaller edge furthest from the body hinges 202 having a much larger fillet so that the cap 300 easily slides over that edge.

In one embodiment, the upper body section 204 has a semicircular cutout 210 on the top face with a flat open side of the cutout on the front edge that allows the user to gain access to the nicotine pouches one at a time while still keeping the remaining pouches contained in the nicotine pouch dispenser 100. In one embodiment, the cutout 210 has retention prongs 208 protruding inwardly from the side edges of the cutout near the front so that the back edge of the nicotine pouch is held by the non-cutout portion and the front section of the nicotine pouch is held by the retention prongs 208, such that the nicotine pouch stays in place and is easily pulled out by the user.

In one embodiment, the body 200 is comprised of materials such as plastic, metal, and/or fiber-reinforced composite. Preferably, the materials used provide a high strength-to-weight ratio for increased durability. In one embodiment, the material used for the body 200 includes a food-safe grade plastic, including but not limited to, ABS (Acrylonitrile Butadiene Styrene), Polycarbonate, Polypropylene, HDPE (High-Density Polyethylene), PET (Polyethylene Terephthalate), PP (Polypropylene), POM (Polyoxymethylene, Acetal). In another embodiment, the material used for the body 200 includes a food-safe grade metal, including but not limited to, carbon steel (e.g., AH36, DH36, EH36, etc.), alloy steel (e.g., of grades MD, ME, MF, MG, etc.), stainless steel (e.g., grades 316, 304, etc.), galvanized steel, aluminum (e.g., grades 5052, 5083, etc.), copper (e.g., C70600, C71500, etc.), brass (e.g., C46200, C46400, C48500, etc.), titanium, and bronze (e.g., C65500, C95400, C51000, etc.). In one embodiment, the body 200 is formed by injection molding. In one embodiment, the entire nicotine pouch dispenser is formed by injection molding.

In one embodiment, the nicotine pouch dispenser is approximately 34 mm wide, approximately 54 mm in height, and approximately 20 mm deep. However, one of ordinary skill in the art will understand that the width, length, and depth of the nicotine pouch dispenser are not intended to be limiting according to the present invention. In one embodiment, the nicotine pouch dispenser is operable to be formed according to the size of the nicotine pouch.

Figure 6:
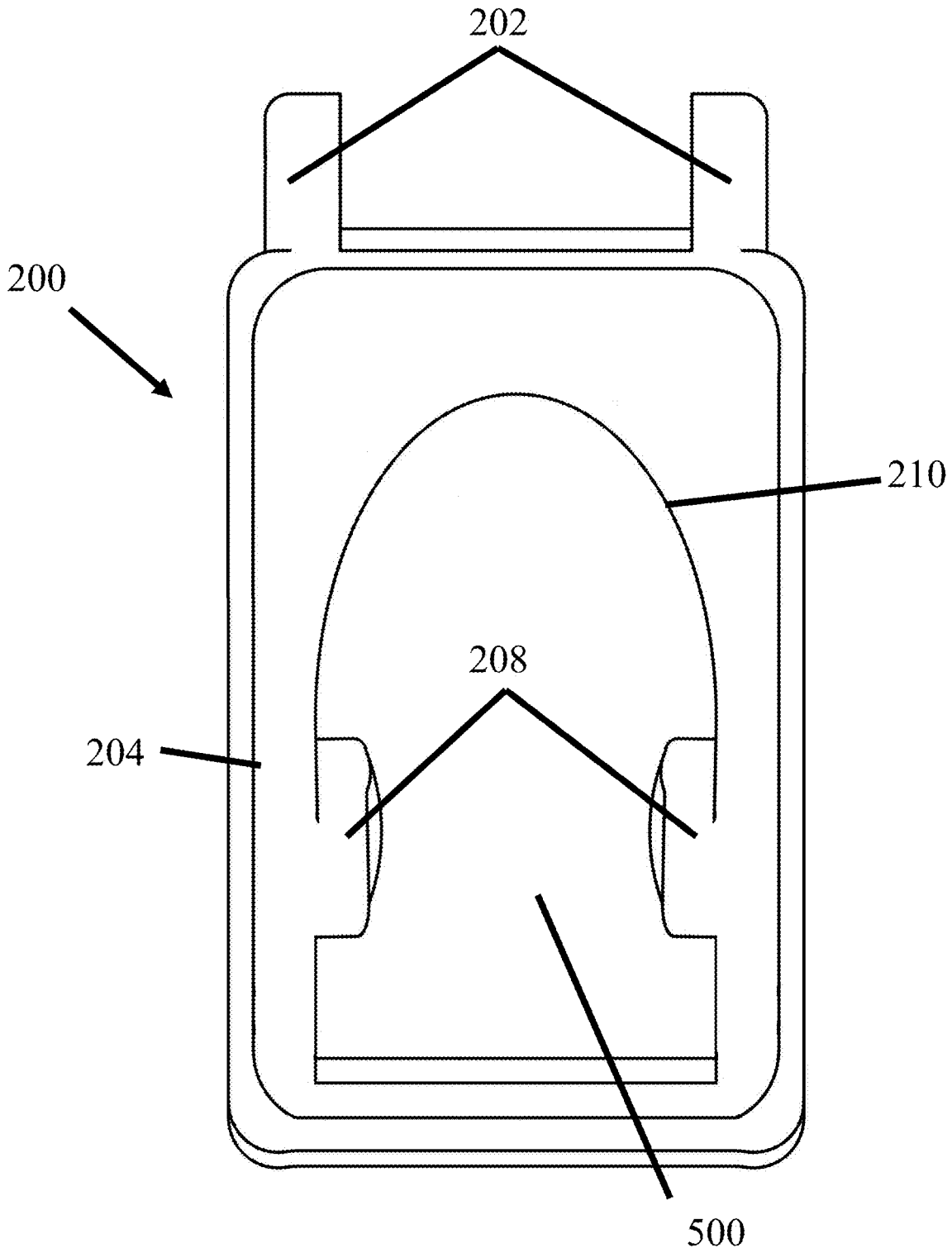
FIG. 6 illustrates a top view of the body of the nicotine pouch dispenser.

FIG. 6 illustrates a top view of the nicotine pouch dispenser body 200 with a plate 500. In one embodiment, the upper body section 204 has a semicircular cutout 210 on the top face with a flat open side of the cutout on the front edge that allows the user to gain access to the nicotine pouches one a time while still keeping the remaining pouches contained in the nicotine pouch dispenser 100. In another embodiment, the cutout 210 is rectangular, triangular, hexagonal, or any similar shape that allows the user access while still containing the nicotine pouches.

In one embodiment, the cutout 210 includes retention prongs 208 protruding inwardly from the side edges of the cutout near the front so that the back edge of the nicotine pouch is held by the non-cutout portion and the front section of the nicotine pouch is held by the retention prongs 208, such that the nicotine pouch stays in place and is easily pulled out by the user.

The plate 500 is installed below the cutout 210 and retention prongs 208. This plate 500 has one or more springs mounted between it and the nicotine pouch dispenser bottom seal 400 so that the plate 500 experiences constant upwards pressure to bring the nicotine pouches to the top of the dispenser where the pouches are available to the user. The nicotine pouches are placed under the cutout 210 and retention prongs 208 and on top of the plate 500, which pushes the plate downward and compresses the one or more springs under the plate 500, thereby keeping constant tension on the pouches and pushing the pouches upward where either the pouches or plate 500 are retained by the cutout 210 and/or retention prongs 208.

Figure 7:
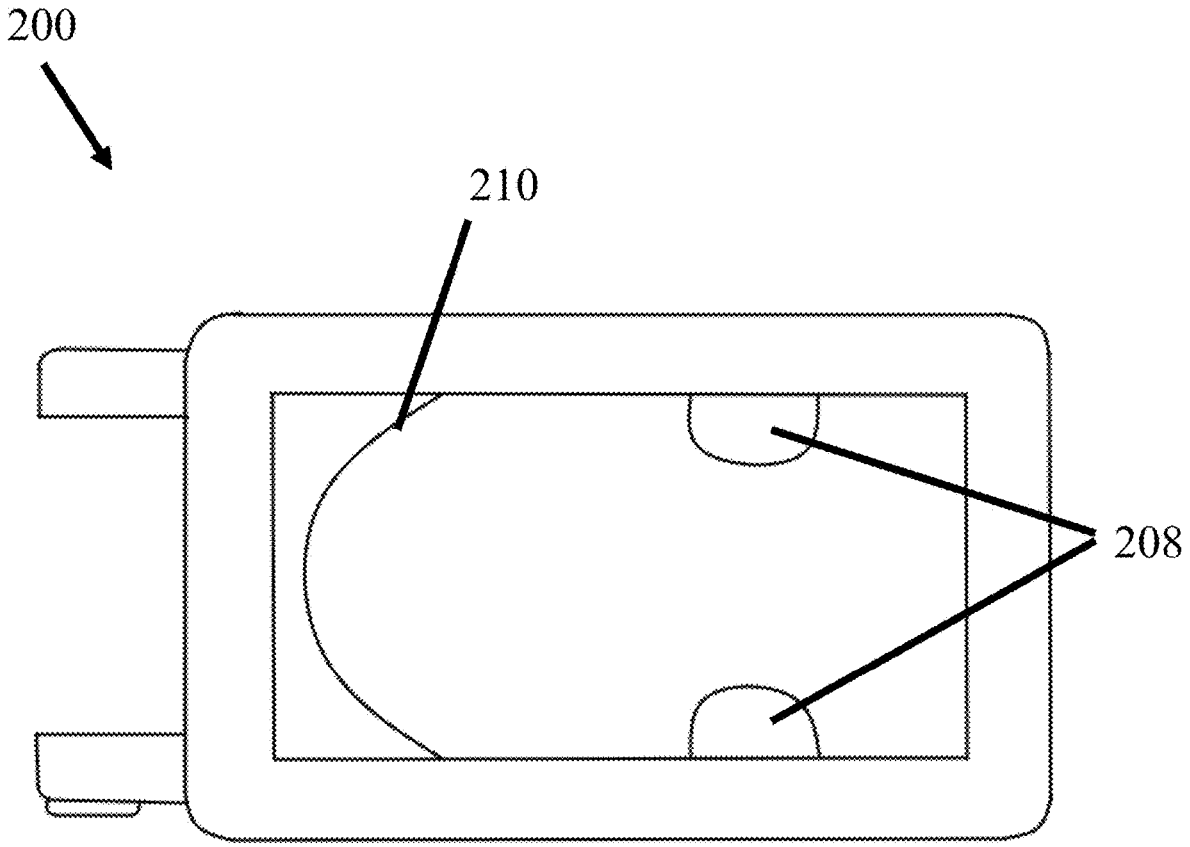
FIG. 7 illustrates a bottom view of the body of the nicotine pouch dispenser.

FIG. 7 illustrates a bottom view of the body 200 of the nicotine pouch dispenser. In one embodiment, the upper body section has a semicircular cutout 210 on the top face with a flat open side of the cutout on the front edge. In another embodiment, the cutout 210 is rectangular, triangular, hexagonal, or any similar shape that allows the user access while still containing the nicotine pouches. In one embodiment, the cutout 210 includes retention prongs 208 protruding inwardly from the side edges of the cutout near the front so that the back edge of the nicotine pouch is held by the non-cutout portion and the front section of the nicotine pouch is held by the retention prongs 208, such that the nicotine pouch stays in place and is easily pulled out by the user.

Figure 8:
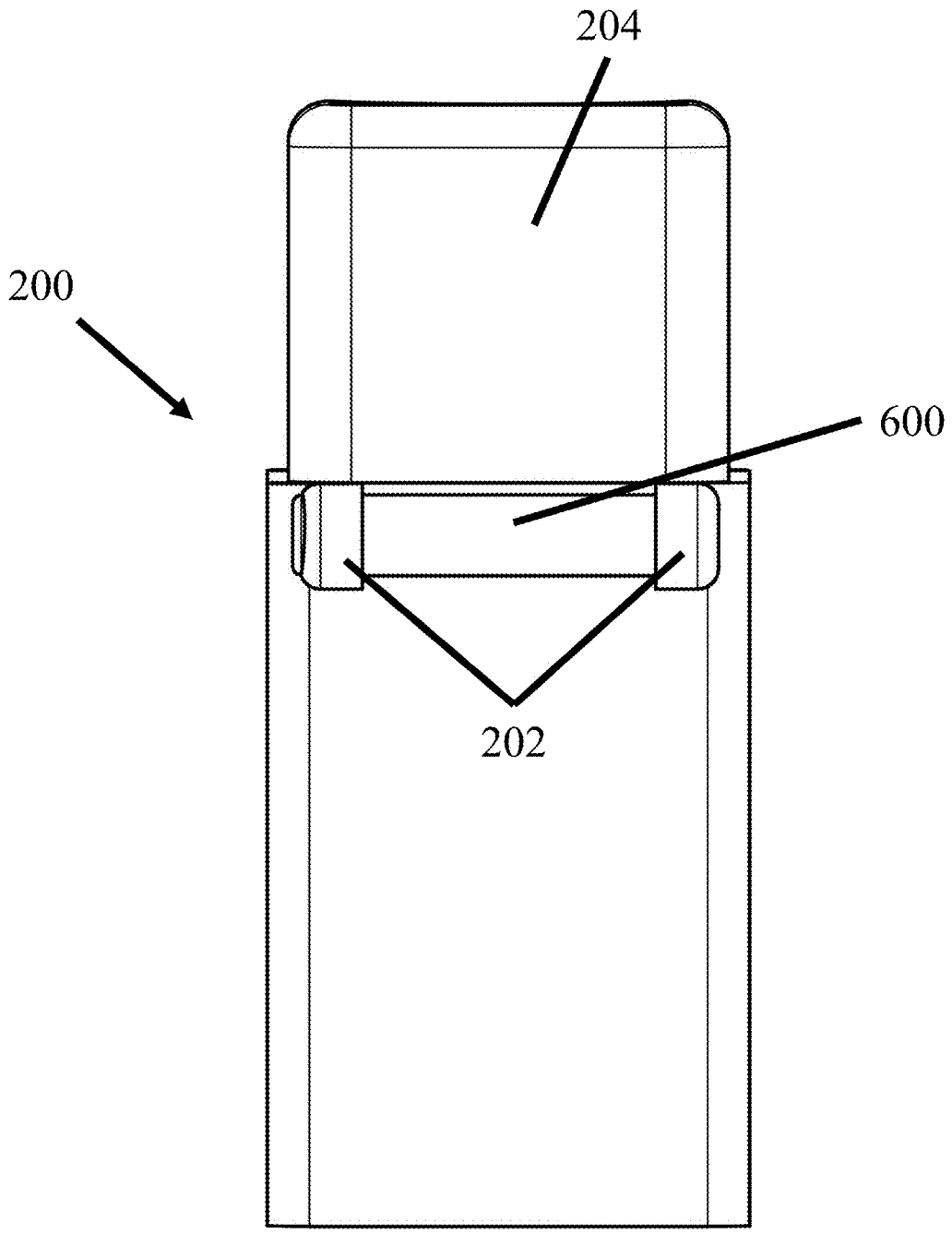
FIG. 8 illustrates a back view of the body of the nicotine pouch dispenser.

FIG. 8 illustrates a back view of the nicotine pouch dispenser body 200 with a pin 600. In one embodiment, one of the body hinges 202 does not have an eye hole going all the way through the hinge, but instead includes a depression defined in an inward facing side, but not extending all the way through. This prevents the pin 600 from sliding through the body hinges 202.

Figure 9:
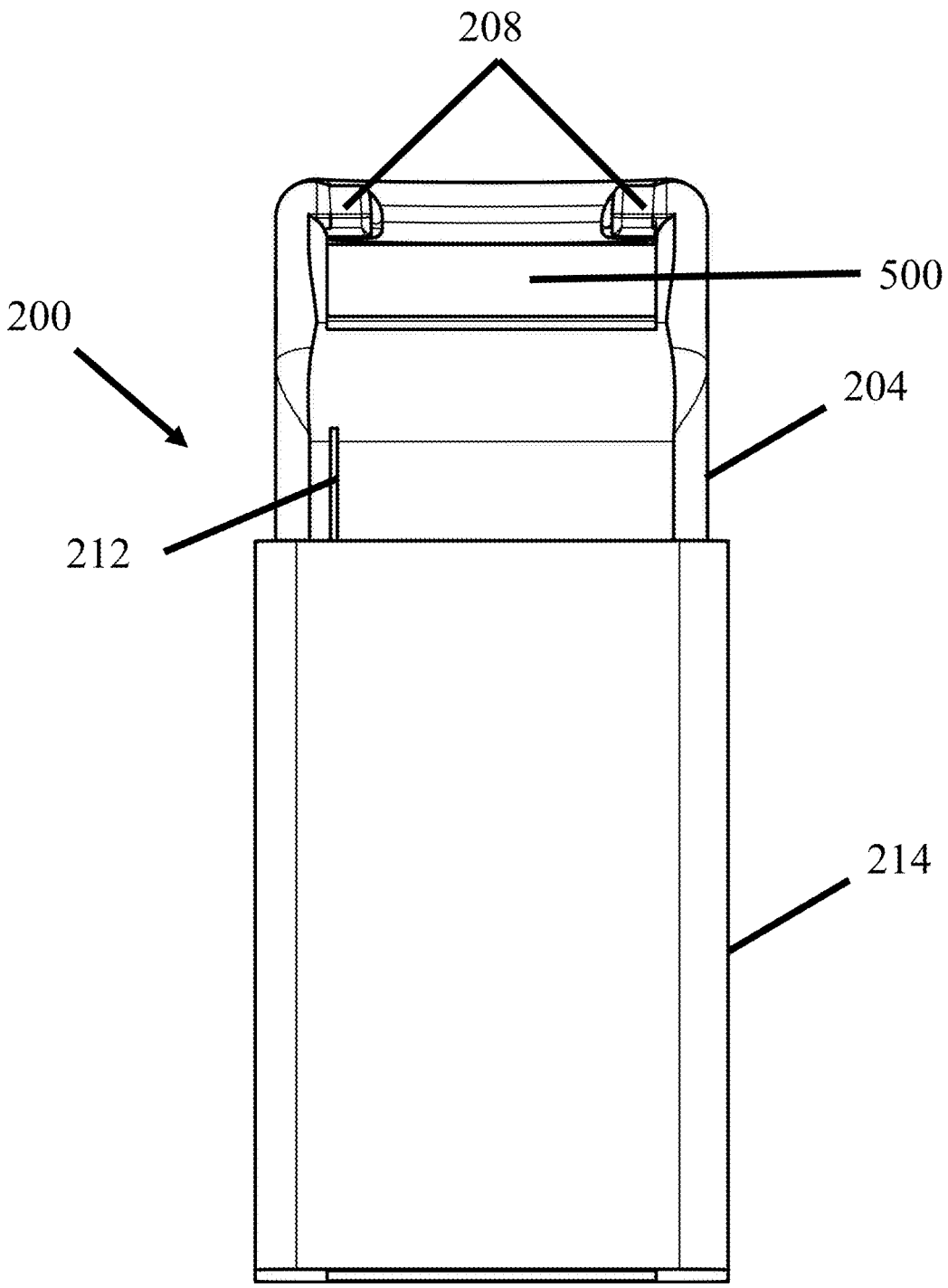
FIG. 9 illustrates a front view of the body of the nicotine pouch dispenser.

FIG. 9 illustrates a front view of the nicotine pouch dispenser body 200. In one embodiment, the body includes a locking prong 212 in the shape a narrow rectangular prism protrusion on the front face of the upper body section 204 that extends from the top lip of the lower body section 214 roughly a third of the way up the front face of the upper body section 204. This locking prong 212 acts as an interference lock with the inside of the cap 300 by pressing against the inside of the lid 300 and holding it in place while the cap 300 is in the closed position. In one embodiment, the locking prong 212 is tapered so that, at the base of the front face of the upper body section 204, the locking prong 212 protrudes forwardly the most and gradually fades to be flush upwardly on the front face, this allows the cap 300 to easily slide into place over the locking prong 212. In one embodiment, the locking prong 212 protrusion is semicircular in shape.

In one embodiment, the locking prong 212 is spring-loaded so that the cap 300 is easily able to slide down onto the top of the upper body section 204 but the spring of the locking prong 212 keeps the cap 300 in place. In another embodiment, the cap 300 and upper body section 204 include corresponding magnets that keep the cap closed when the dispenser is not in use.

Figure 10:
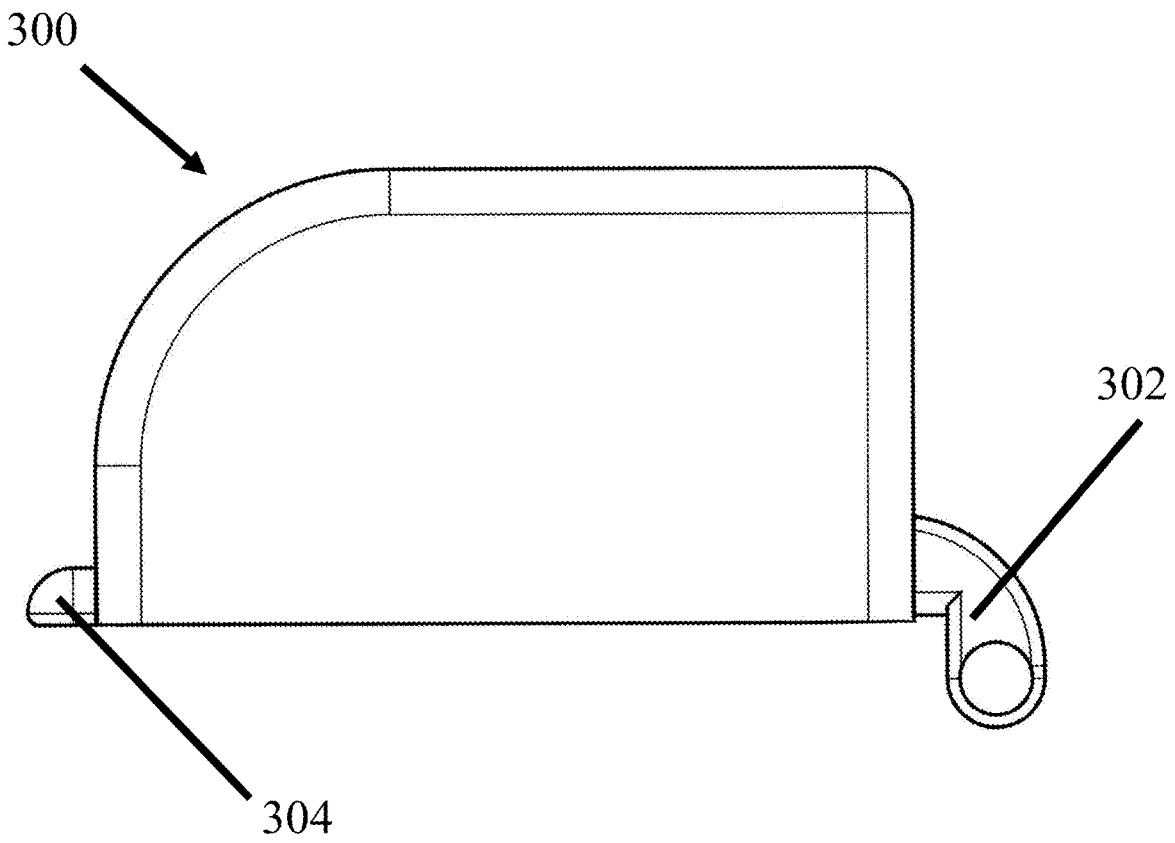
FIG. 10 illustrates a side view of the top cap of the nicotine pouch dispenser.
Figure 11:
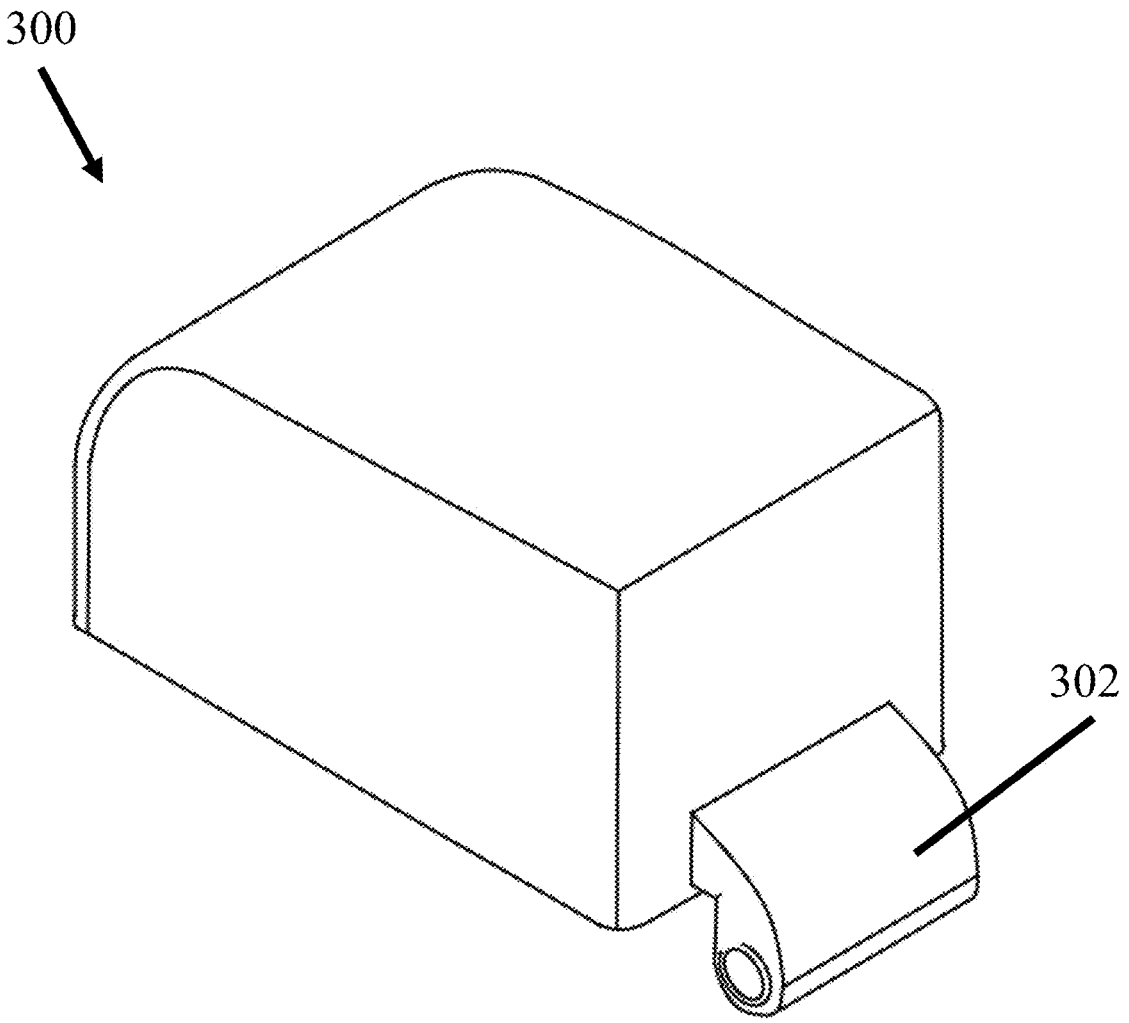
FIG. 11 illustrates a perspective view of the top cap of the nicotine pouch dispenser.

FIGS. 10 and 11 illustrate side and perspective views of the top cap 300 of the nicotine dispenser, respectively. In one embodiment, the cap 300 is the shape of a hollow rectangular prism with no bottom face and the top back and front faces being filled and the latter being a significantly larger fillet so that the inside of the cap 300 matches and rotates on top of the upper body section 214 of the body 200. There are also fillets and/or chamfers on all edges except the bottom edge so that the nicotine pouch dispenser 100 is comfortable for a user to hold. In one embodiment, the cap 300 is comprised of materials such as plastic, metal, and/or fiber-reinforced composite. Preferably, the materials used provide a high strength-to-weight ratio for increased durability. In one embodiment, the material used for the cap 300 includes a food-safe grade plastic, including but not limited to, ABS (Acrylonitrile Butadiene Styrene), Polycarbonate, Polypropylene, HDPE (High-Density Polyethylene), PET (Polyethylene Terephthalate), PP (Polypropylene), POM (Polyoxymethylene, Acetal). In another embodiment, the material used for the body 200 includes a food-safe grade metal, including but not limited to, carbon steel (e.g., AH36, DH36, EH36, etc.), alloy steel (e.g., of grades MD, ME, MF, MG, etc.), stainless steel (e.g., grades 316, 304, etc.), galvanized steel, aluminum (e.g., grades 5052, 5083, etc.), copper (e.g., C70600, C71500, etc.), brass (e.g., C46200, C46400, C48500, etc.), titanium, and bronze (e.g., C65500, C95400, C51000, etc.). In one embodiment, the cap 300 is formed by injection molding.

In one embodiment, the dispenser includes a cap hinge 302 that protrudes outwardly from the center of the back face of the cap 300. The bottom portion of the cap hinge 302 is perpendicular to the back face where the cap hinge 302 is attached to the back face, and then curves ninety-degrees downwardly, extending below the bottom face of the cap 300 to meet and line up with the body hinges 202 eye holes. The eye holes of the cap hinge 302 are substantially horizontal so that the pin 600 will slide through into place substantially horizontally. In another embodiment, there is more than one cap hinge 302 to ensure greater strength of the hinge.

In one embodiment, a lip 304 protrudes forwardly from the front face of the cap 300 and has a flat bottom face that is flush with the bottom face of the cap 300. In one embodiment, the lip 304 has a rectangular prism shape with fileted or chamfered outside edges so that it is comfortable and safe to open and close the cap 300.

Figure 12:
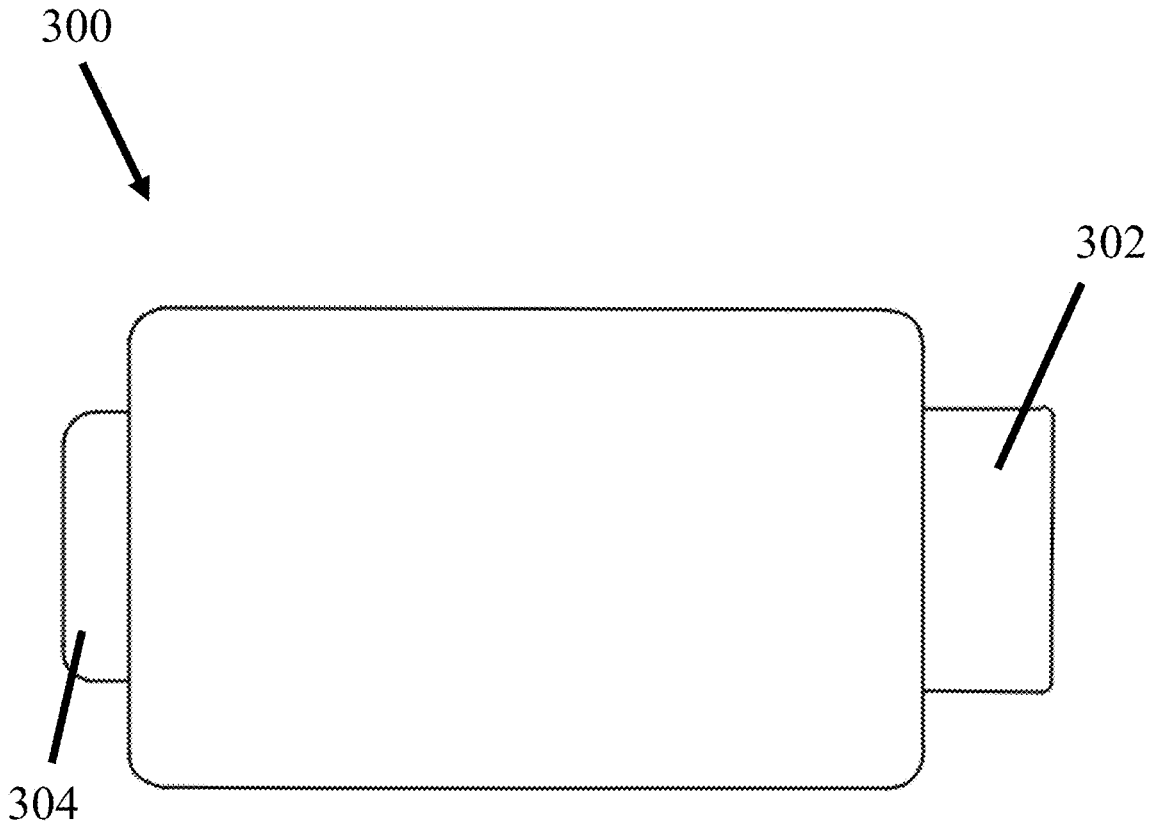
FIG. 12 illustrates a top view of the top cap of the nicotine pouch dispenser.
Figure 13:
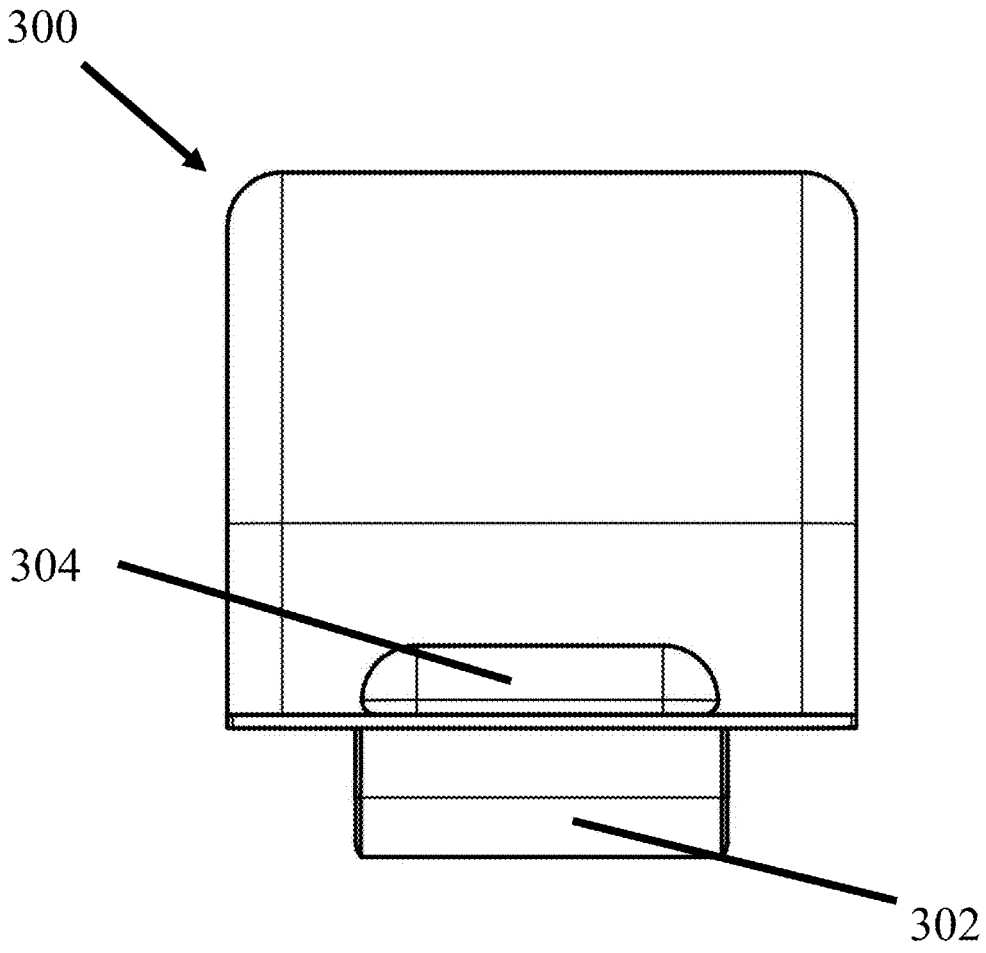
FIG. 13 illustrates a back view of the top cap of the nicotine pouch dispenser.
Figure 14:
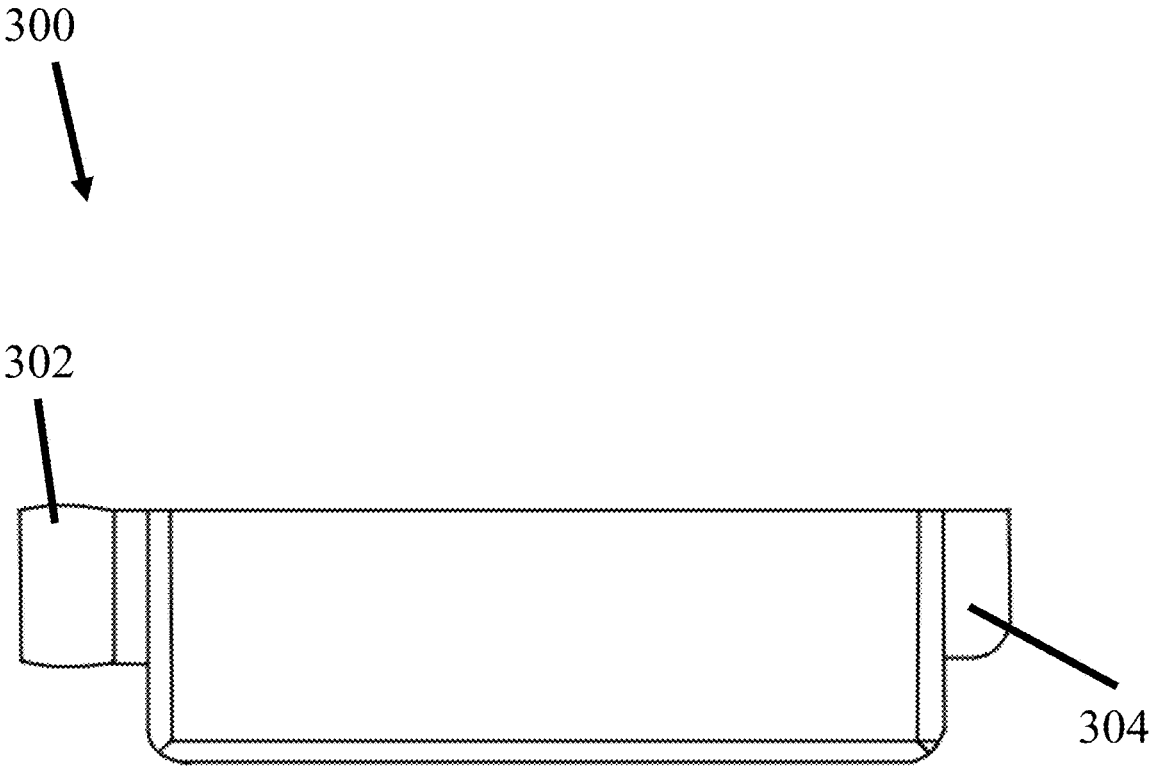
FIG. 14 illustrates a side view of the top cap of the nicotine pouch dispenser.

FIGS. 12-14 illustrates a top, front, and side views of the top cap 300 of the nicotine pouch dispenser, respectively. In one embodiment, the lip 304 is a protrusion from the body of the cap 300 which is secured to the body of the cap 300 through a slot, or which is integrally formed with the body of the cap 300. The lip 304 is configured to allow the user to position their finger or nail under the lip 304 to remove the cap 300 from the nicotine pouch dispenser. In one embodiment, the dispenser includes a cap hinge 302 that protrudes out of the center of the back face of the cap 300.

Figure 15:
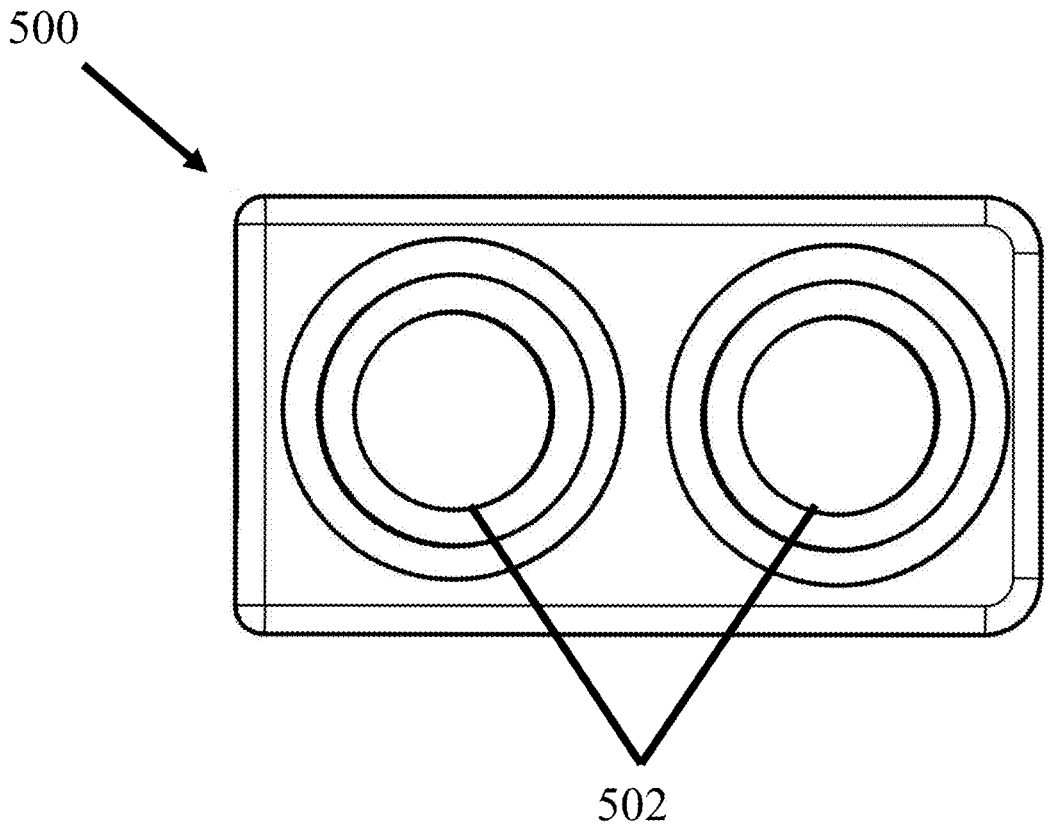
FIG. 15 illustrates a bottom view of the nicotine pouch dispenser plate.

FIG. 15 illustrates a bottom view of the nicotine pouch dispenser plate 500. In one embodiment, the plate 500 is rectangularly prismatic in shape with a fillet or chamfer on all edges and is sized to fit and slide within the inside of the body 200 of the nicotine pouch dispenser 100.

In one embodiment, the plate includes two cylindrical extensions 502 protruding from the bottom side of the plate 500. The center of the cylindrical extensions 502 are positioned an equal distance from each other and an equal distance from the two smaller edges of the plate 500, and also positioned on the center of the plate 500 between the two longer edges of the plate 500. These cylindrical extensions 502 are placed so that they are positioned to hold the plate 500 in a balanced way such that the plate 500 is operable to support a load such as one or more nicotine pouches.

In one embodiment, two springs are positioned around the cylindrical extensions 502. The cylindrical extensions 502 keep the springs in place and centered so that they balance the plate 500. The springs are installed under the plate and on top of the bottom seal 400 so that the springs push against the bottom seal 400 and push the plate 500 up towards the top of the body 200. The springs uncompressed are longer than the height of the body 200 so that there is constant pressure on the underside of the plate. The springs are also able to be compressed to the size of the length of the cylindrical extensions 502 so that the plate moves down as far as possible without bottoming out the spring. The spring also is easy to press down for almost all users, requiring less than ten pounds of pressure so it is easily filled. In one embodiment, there is only one spring and one cylinder 502 located in the center of the plate to minimize the number of parts required. In one embodiment, the spring is a coil spring, leaf spring, torsion spring, elastic band/cord, pneumatic cylinder, hydraulic mechanism, magnetic repulsion, vertical leaf spring, or any other similar mechanism. In one embodiment, the spring is made of stainless steel (e.g., grades 316, 304, etc.).

Figure 16:
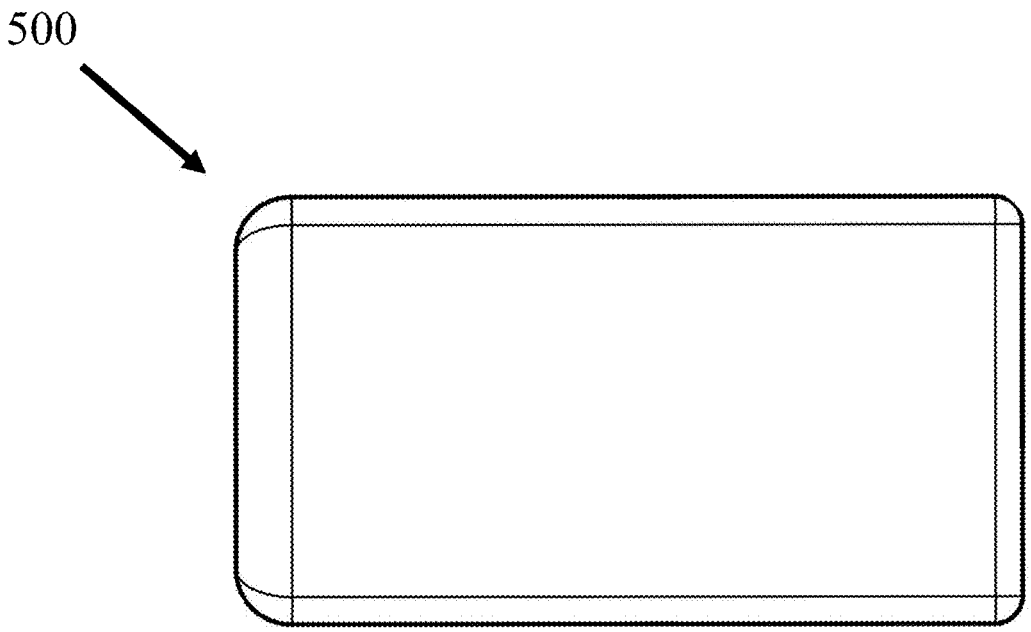
FIG. 16 illustrates a top view of the nicotine pouch dispenser plate.
Figure 17:
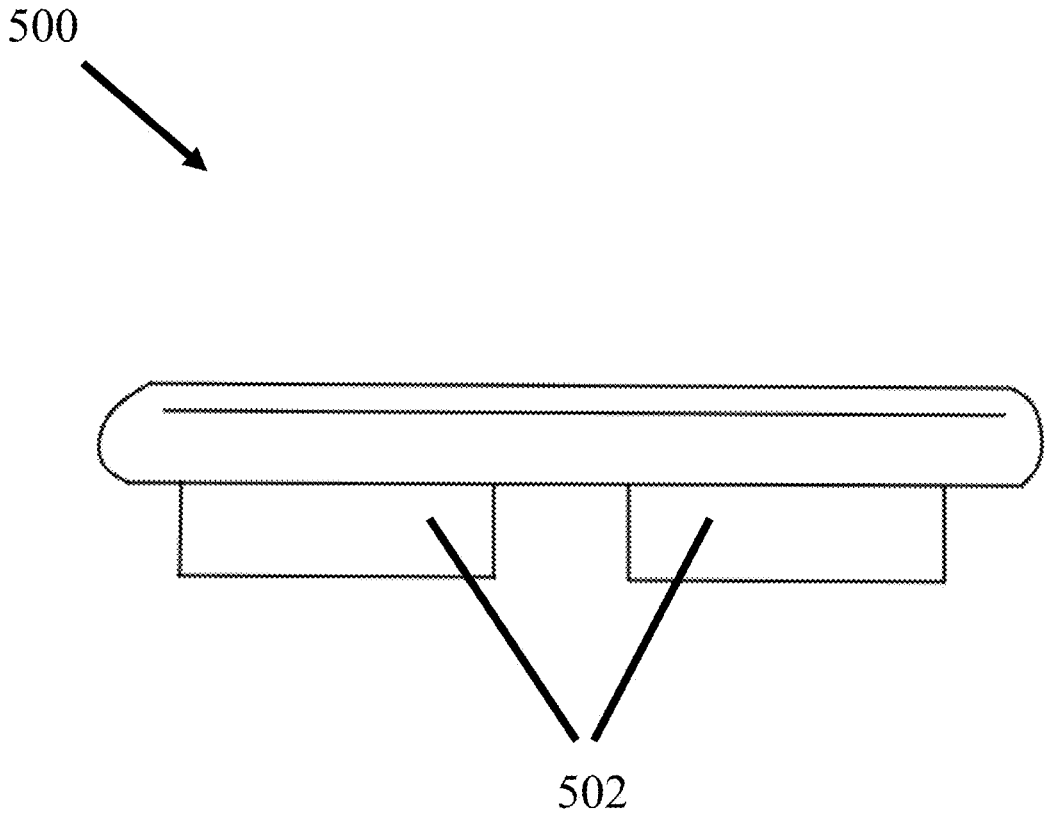
FIG. 17 illustrate a side view of the nicotine pouch dispenser plate.
Figure 18:
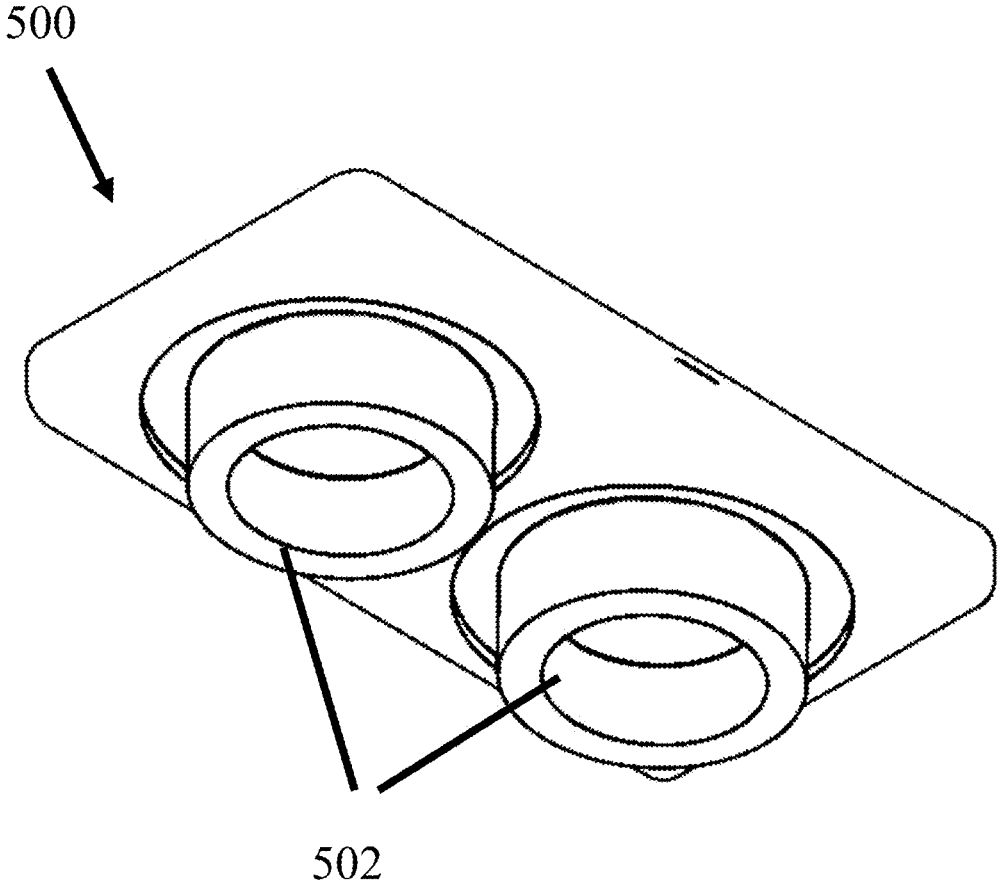
FIG. 18 illustrates a perspective view of the nicotine pouch dispenser plate.

FIGS. 16-18 illustrate top, side, and perspective views of the nicotine pouch dispenser plate 500, respectively. In one embodiment, the front top edge of the plate 500 has a larger fillet or chamfer on it to allow the pouch to more easily slide on and off of the plate 500. In one embodiment, the plate includes two cylindrical extensions 502 protruding from the bottom side of the plate 500.

Figure 19:
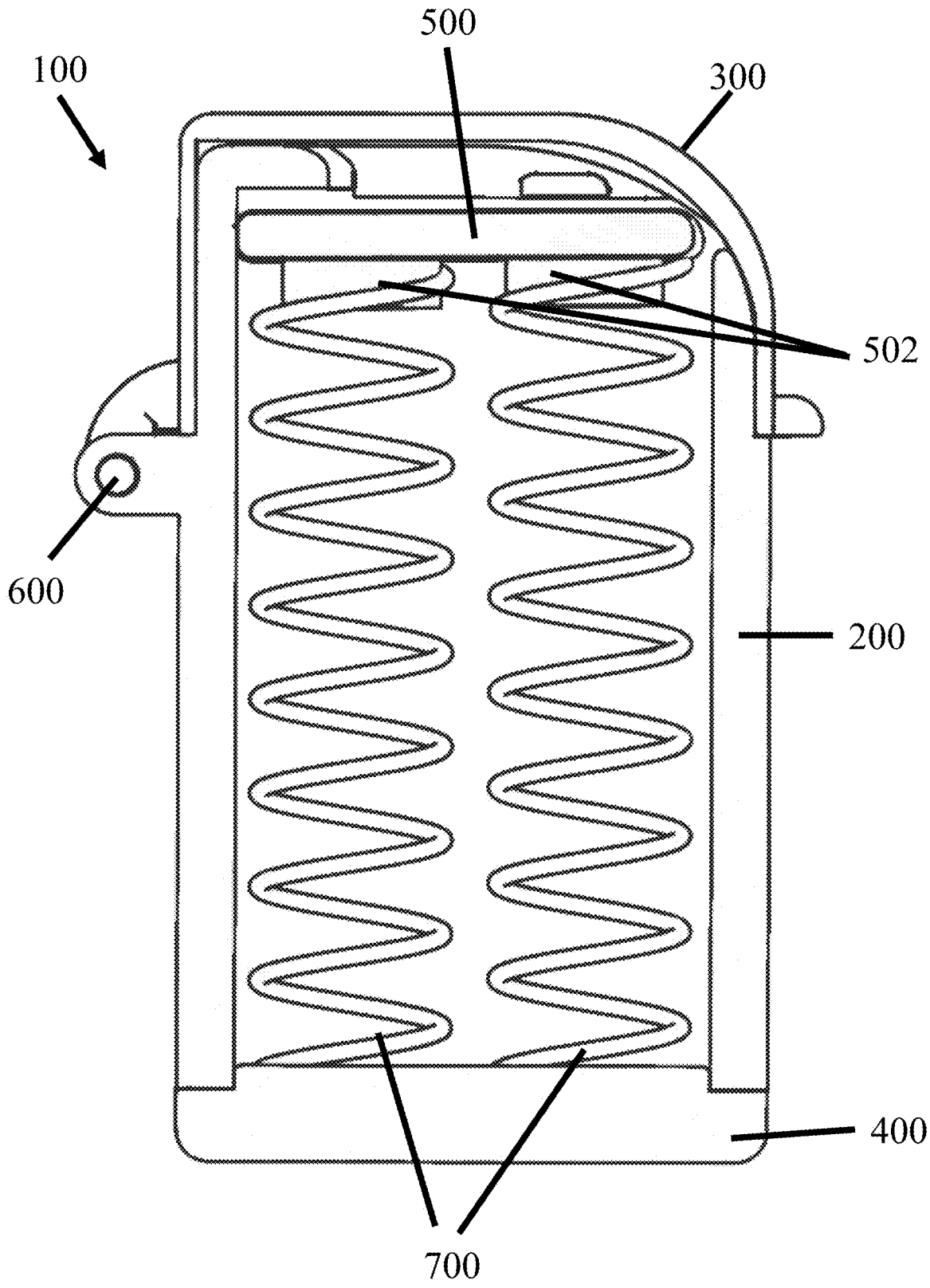
FIG. 19 illustrates an interior side view of the nicotine pouch dispenser.

FIG. 19 illustrates an interior side view of the nicotine pouch dispenser 100. In one embodiment, the nicotine pouch dispenser 100 outer shell is comprised of four main components, the body 200, the cap 300, the bottom seal 400, and the pin 600. In one embodiment, the nicotine pouch dispenser includes a nicotine pouch dispenser plate 500. In one embodiment, the nicotine pouch dispenser plate 500 includes two cylindrical extensions 502 protruding from the bottom side of the plate 500. These cylindrical extensions 502 are positioned with their center equal distance from each other and from the two smaller edges of the plate 500 and on the center between the two longer edges of the plate 500 so that they are positioned to hold the plate 500 in a balanced way such that the plate 500 is operable to support a load such as one or more nicotine pouches. In one embodiment, two springs 700 are positioned around the cylindrical extensions 502. The cylindrical extensions 502 keep the springs 700 in place and centered so that they balance the plate 500. The springs are installed under the plate and on top of the bottom seal 400 so that the springs push against the bottom seal 400 and push the plate 500 upwardly towards the top of the body 200.

Figure 20:
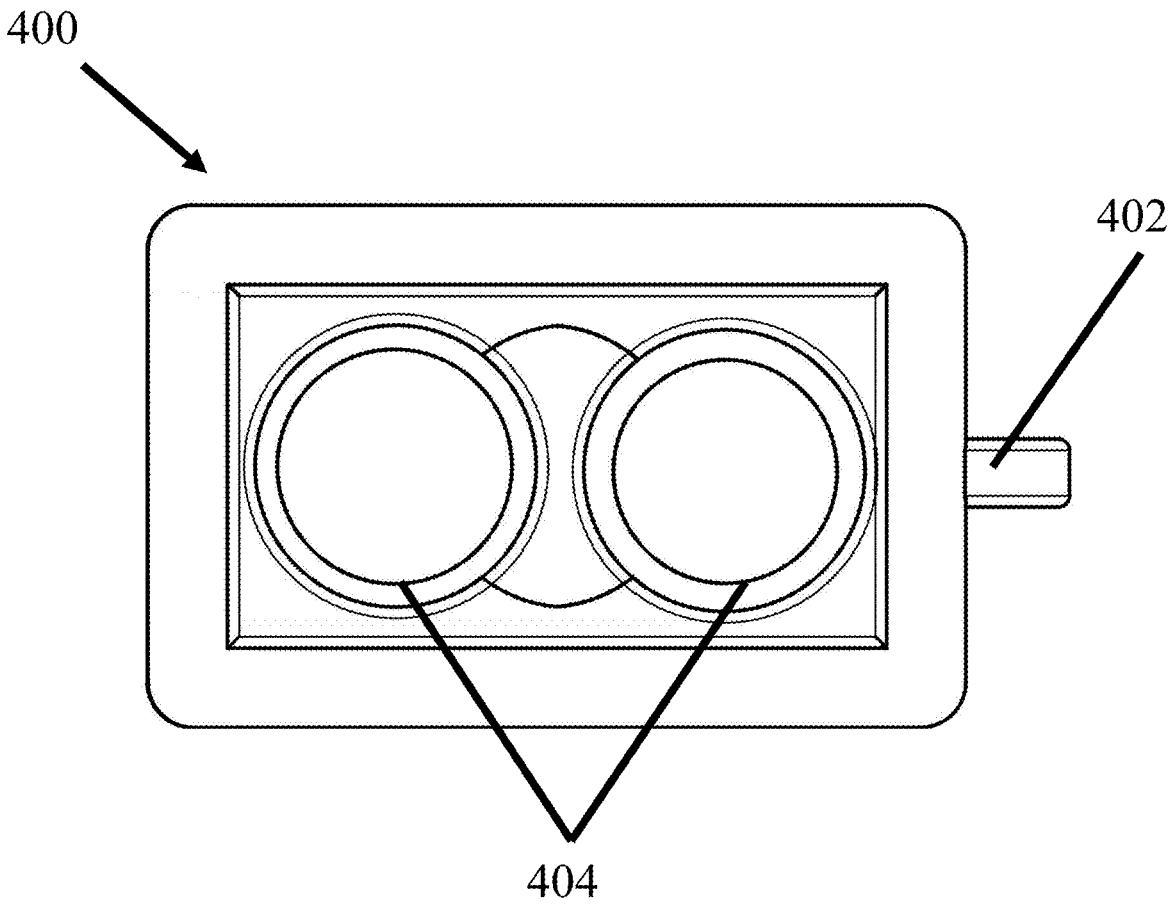
FIG. 20 illustrates a top view of the bottom of the nicotine pouch dispenser.
Figure 21:
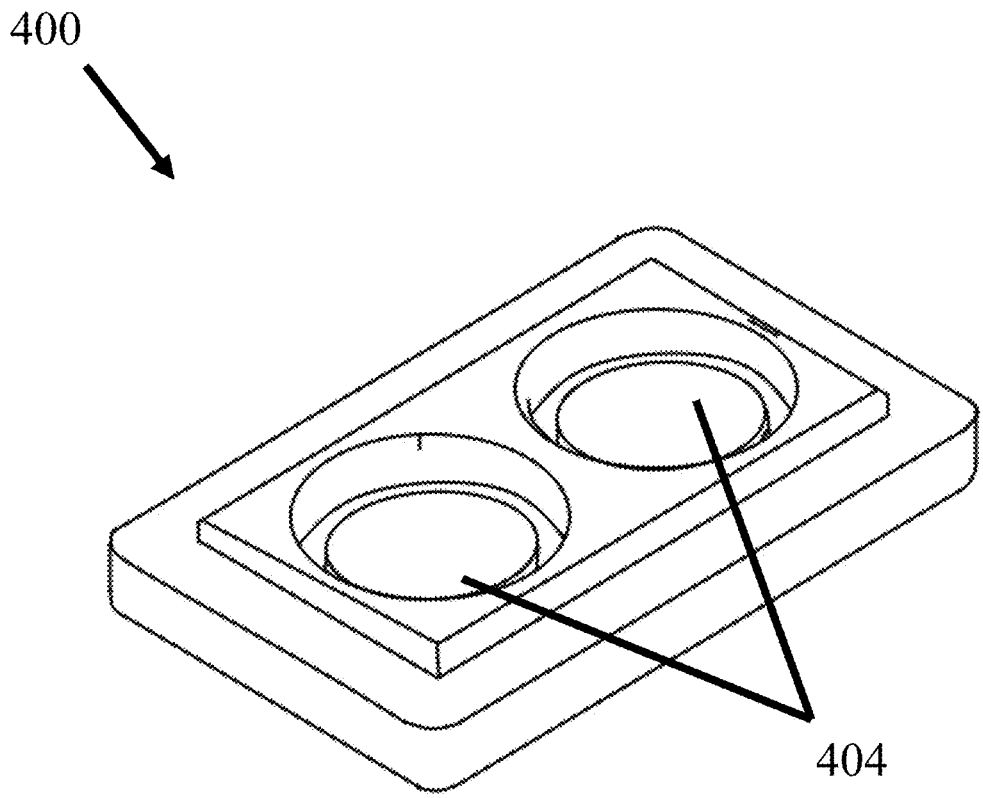
FIG. 21 illustrates a perspective view of the bottom of the nicotine pouch dispenser.

FIGS. 20 and 21 illustrate top and perspective views of the bottom seal 400 of the nicotine pouch dispenser, respectively. In one embodiment, the bottom seal 400 is in the shape of a rectangular prism with filleted or chamfered edges except on the top. The top face of the bottom seal 400 is hollowed out, and cylindrical extensions 404 protrude from this hollowed-out section. These cylindrical extensions 404 act as a retainer for the bottom of the springs 700 by keeping the springs in place and aligned vertically so that the plate has an even distribution of pressure from both springs.

In one embodiment, the bottom seal 400 includes a ring 402 or hollow cylinder protruding from the back face so that the bottom of the ring 402 is substantially flush and parallel with the lower edge of the lower body section. The eye hole of the ring 402 is operable to receive a split ring, carabiner, lanyard, or other similar attachment system so that the nicotine pouch dispenser is easily transportable by a user.

In one embodiment, the bottom seal 400 is comprised of materials such as plastic, metal, and/or fiber-reinforced composite. Preferably, the materials used provide a high strength-to-weight ratio for increased durability. In one embodiment, the material used for the bottom seal 400 includes a food-safe grade plastic, including but not limited to: ABS (Acrylonitrile Butadiene Styrene), Polycarbonate, Polypropylene, HDPE (High-Density Polyethylene), PET (Polyethylene Terephthalate), PP (Polypropylene), POM (Polyoxymethylene, Acetal). In another embodiment, the material used for the body 200 includes a food-safe grade metal, including but not limited to, carbon steel (e.g., AH36, DH36, EH36, etc.), alloy steel (e.g., of grades MD, ME, MF, MG, etc.), stainless steel (e.g., grades 316, 304, etc.), galvanized steel, aluminum (e.g., grades 5052, 5083, etc.), copper (e.g., C70600, C71500, etc.), brass (e.g., C46200, C46400, C48500, etc.), titanium, and bronze (e.g., C65500, C95400, C51000, etc.). In one embodiment, the bottom seal 400 is formed by injection molding.

Figure 22:
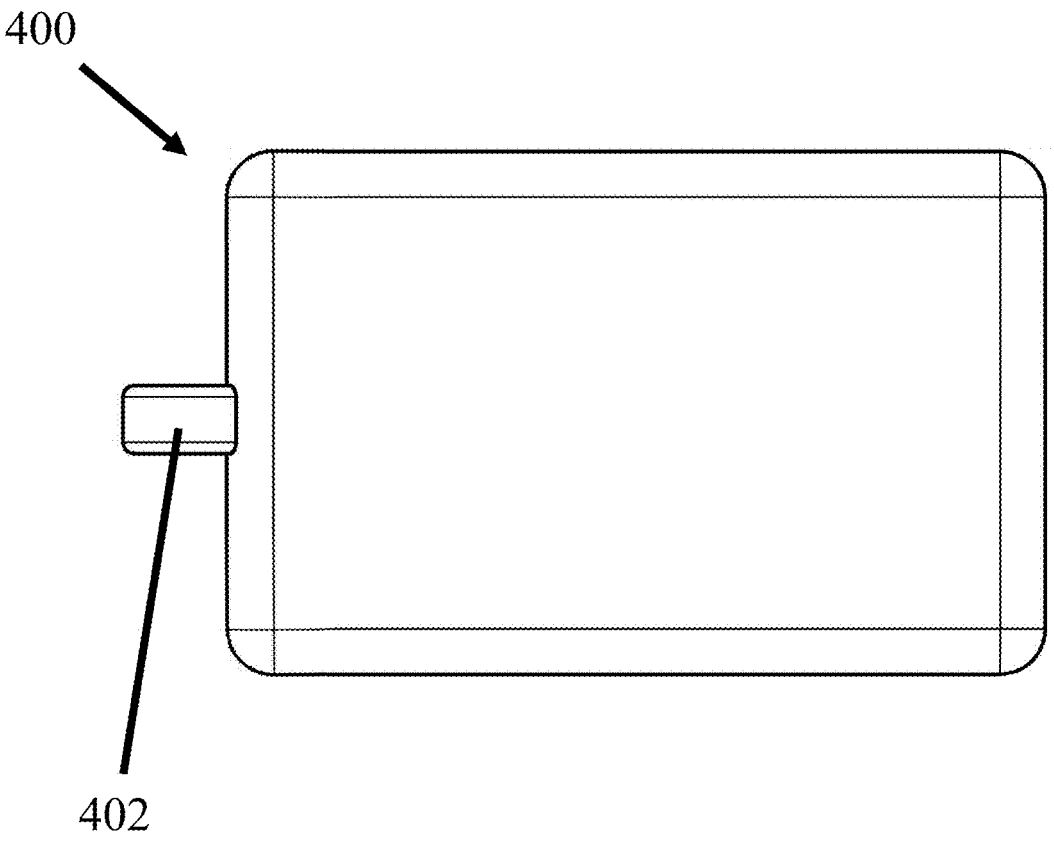
FIG. 22 illustrates a bottom view of the bottom of the nicotine pouch dispenser.
Figure 23:
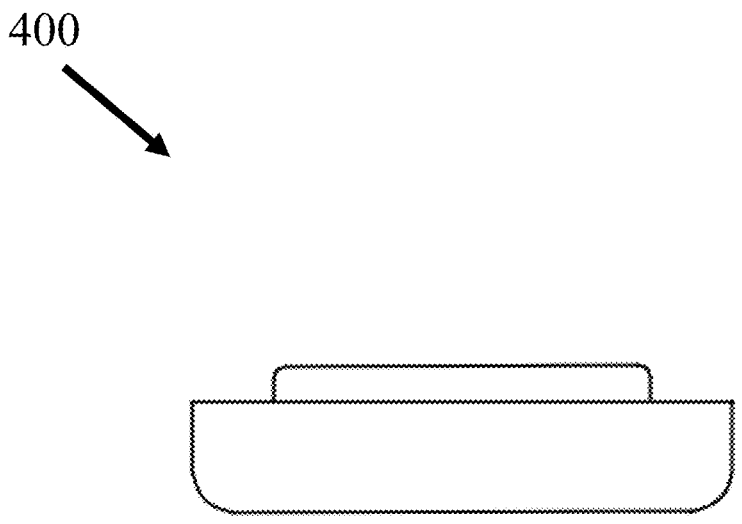
FIG. 23 illustrates a front view of the bottom of the nicotine pouch dispenser.
Figure 24:
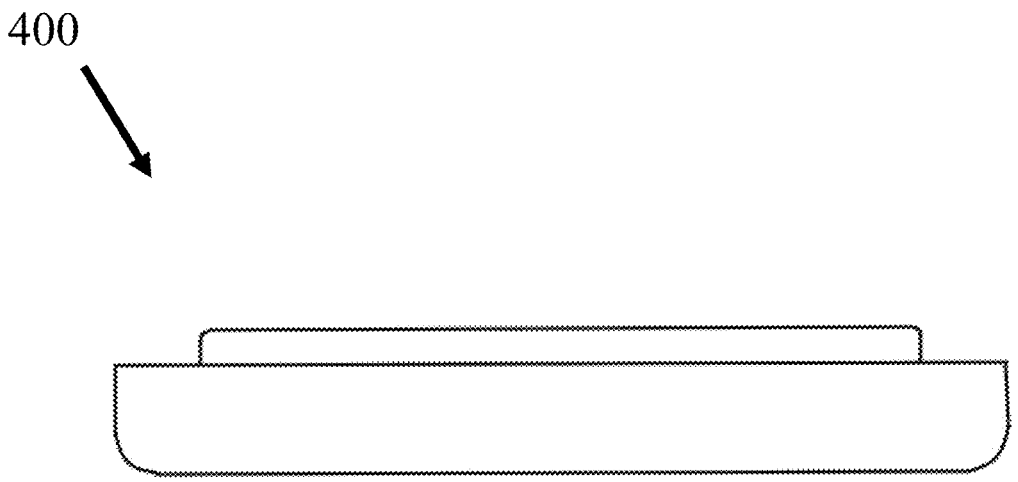
FIG. 24 illustrates a side view of the bottom of the nicotine pouch dispenser.

FIGS. 22-24 illustrate a bottom, front, and side views of the bottom seal 400 of the nicotine pouch dispenser, respectively. In one embodiment, the bottom seal 400 has at least one ring 402 protruding from the outer edge of the nicotine pouch dispenser providing for attachment to another object so that the user is able to easily transport the item.

Figure 25:
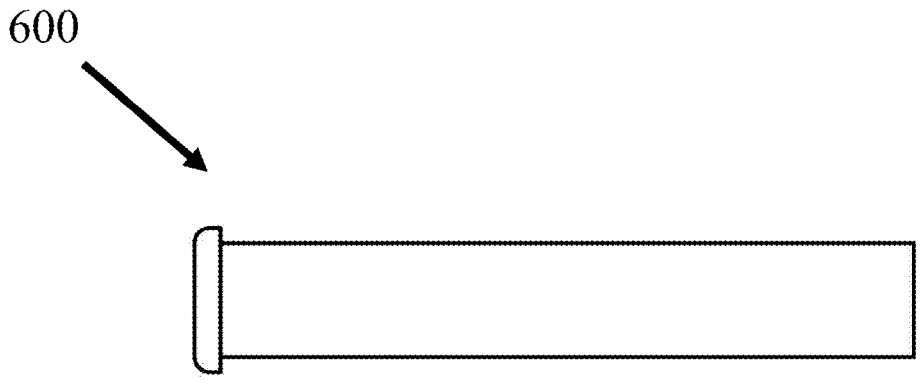
FIG. 25 illustrates a side view of the pin of the nicotine pouch dispenser.
Figure 26:
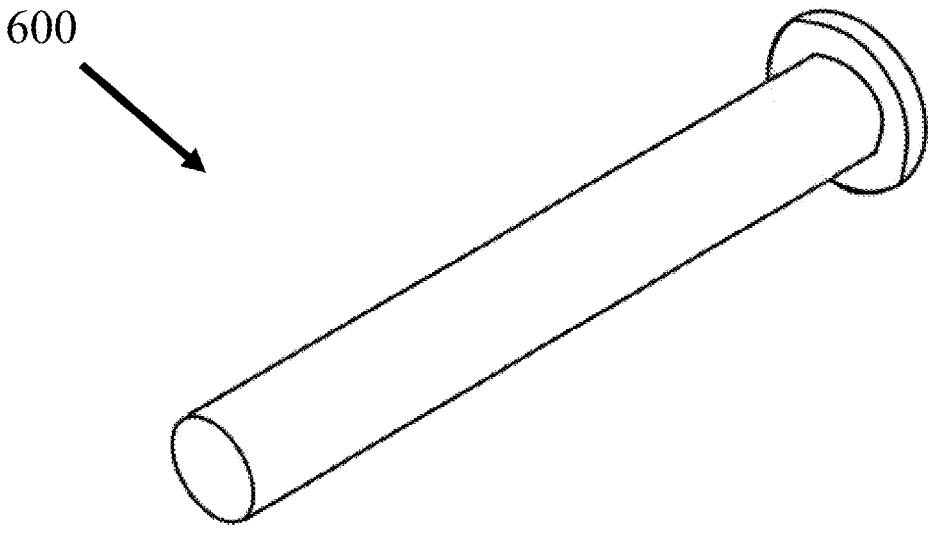
FIG. 26 illustrates a perspective view of the pin of the nicotine pouch dispenser.
Figure 27A:
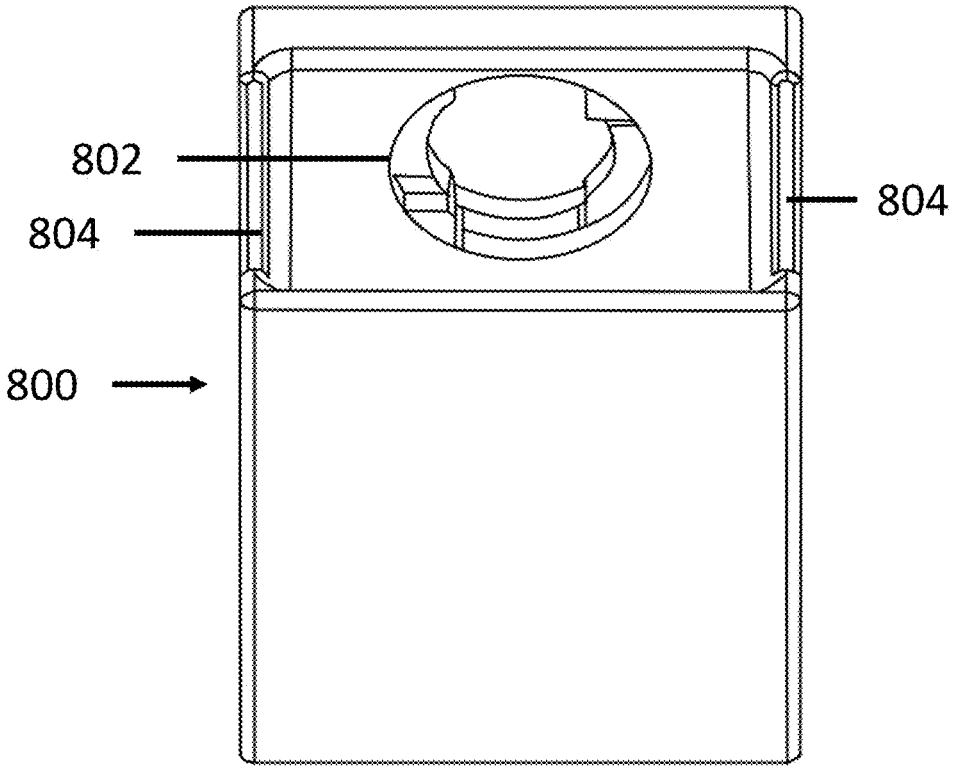
FIG. 27A illustrates a perspective right side view of the nicotine pouch dispenser holster.
Figure 27B:
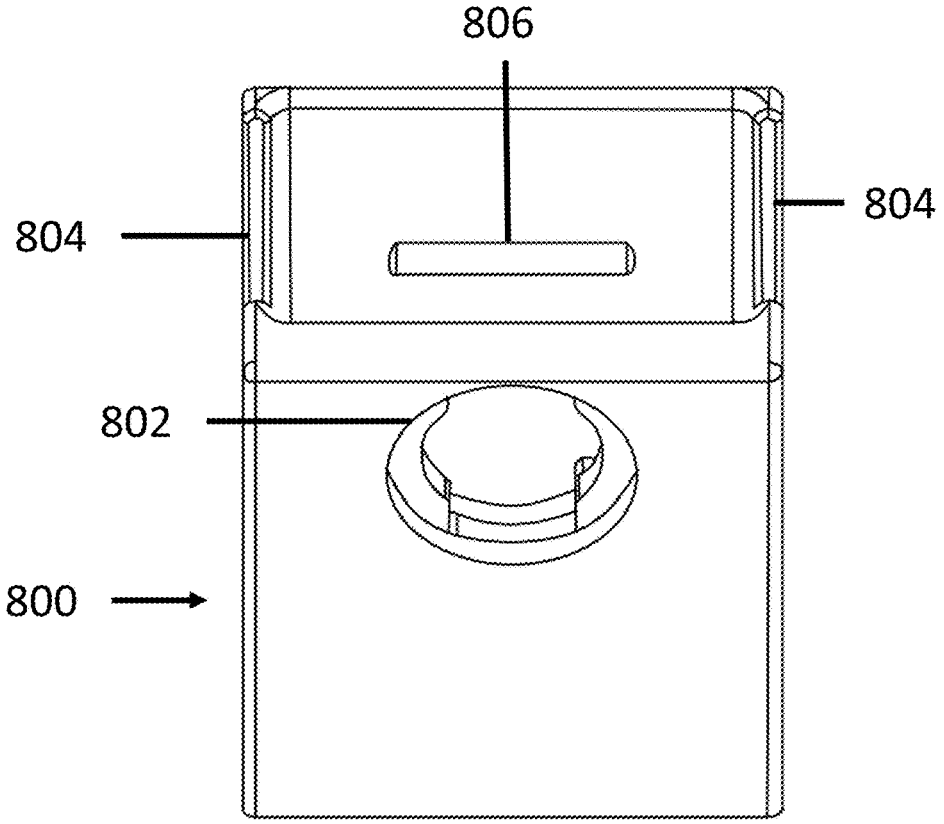
FIG. 27B illustrates a perspective left side view of the nicotine pouch dispenser holster.
Figure 27C:
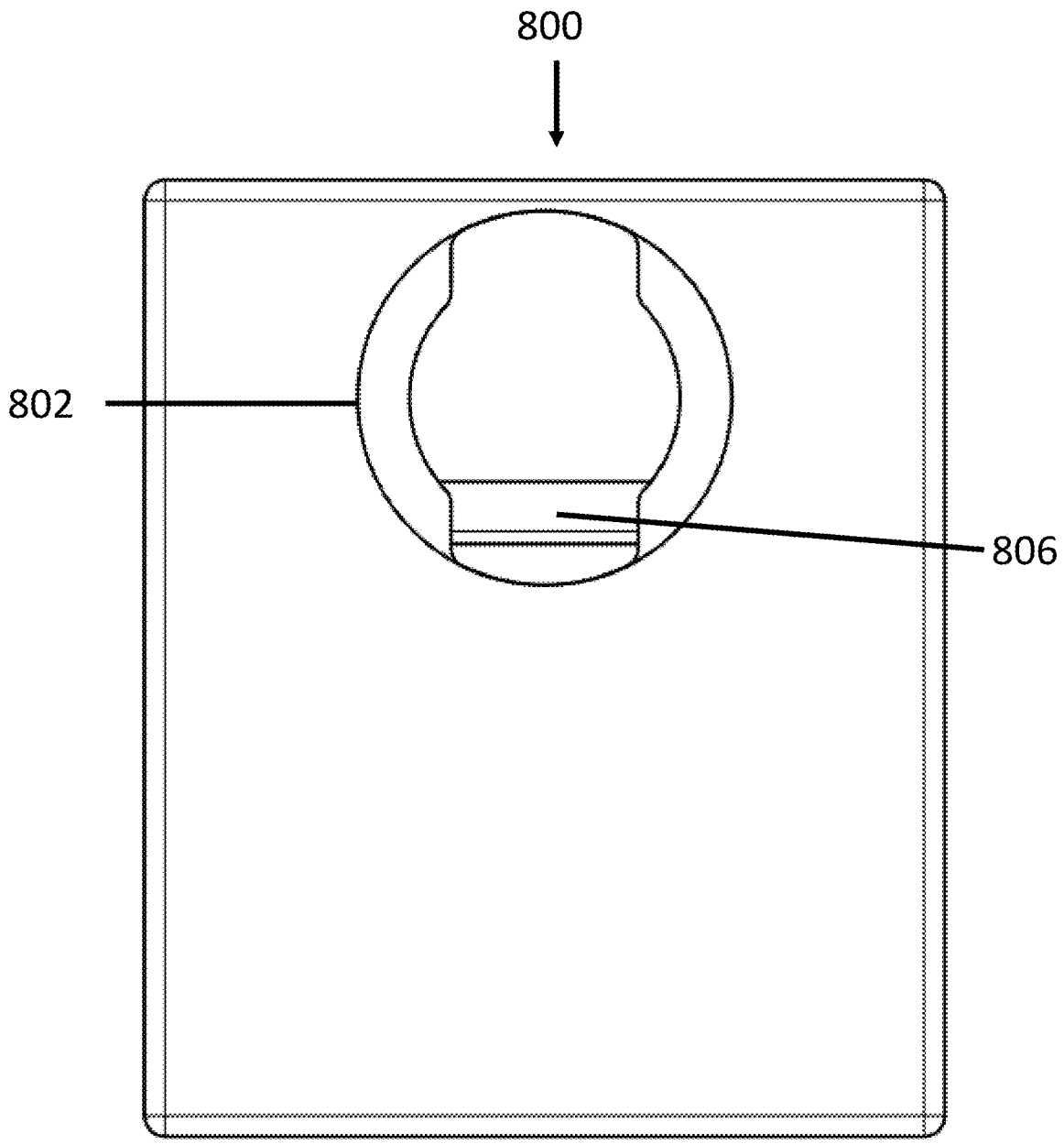
FIG. 27C illustrates a left side view of the nicotine pouch dispenser holster.
Figure 27D:
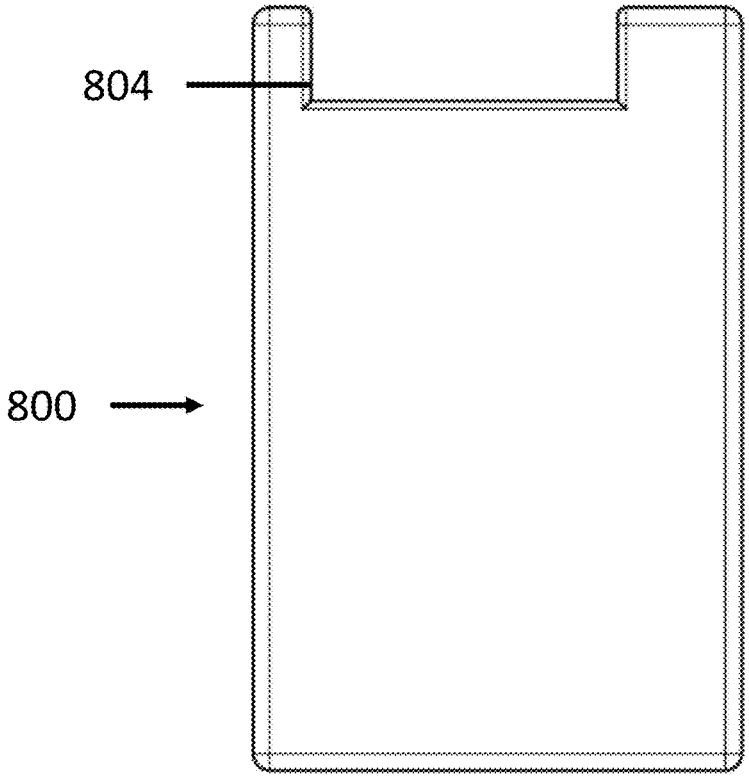
FIG. 27D illustrates a back view of the nicotine pouch dispenser holster.
Figure 27E:
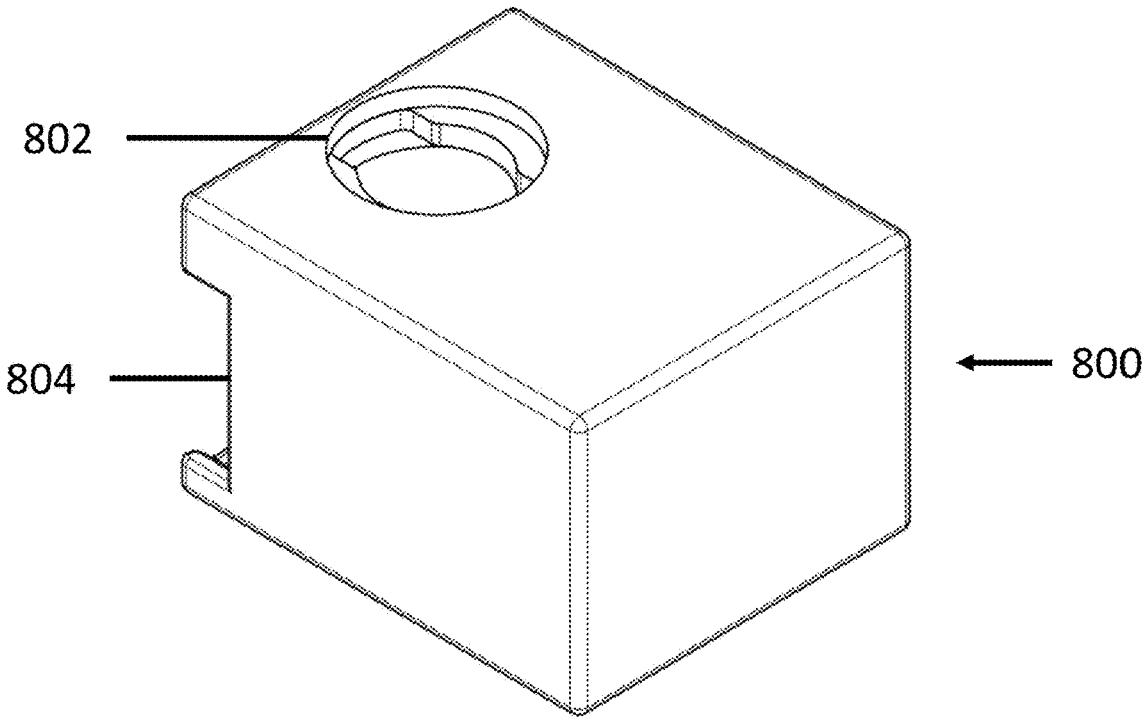
FIG. 27E illustrates a bottom perspective view of the nicotine pouch dispenser holster.
Figure 27F:
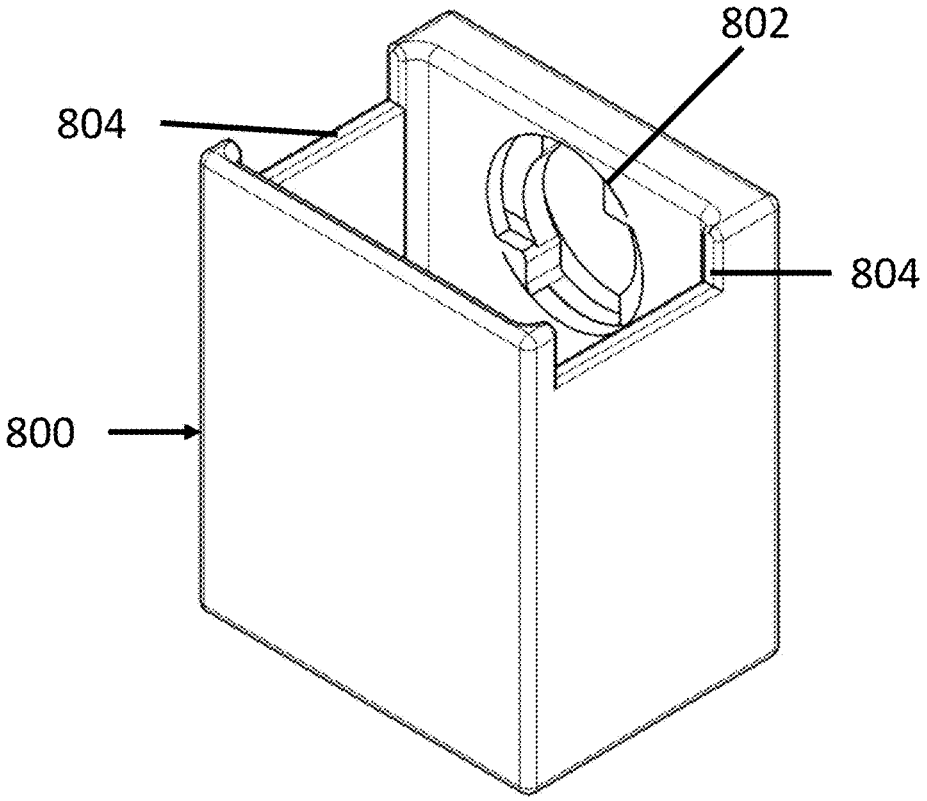
FIG. 27F illustrates a top perspective view of the nicotine pouch dispenser holster.
Figure 27G:
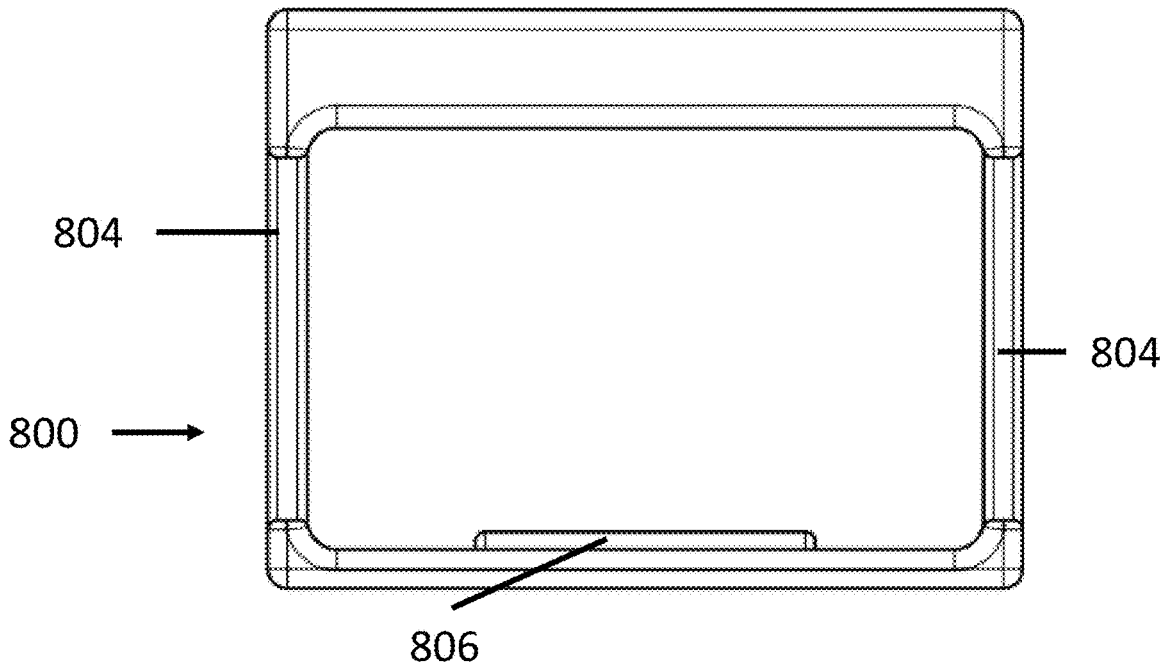
FIG. 27G illustrates a top view of the nicotine pouch dispenser holster.
Figure 28A:
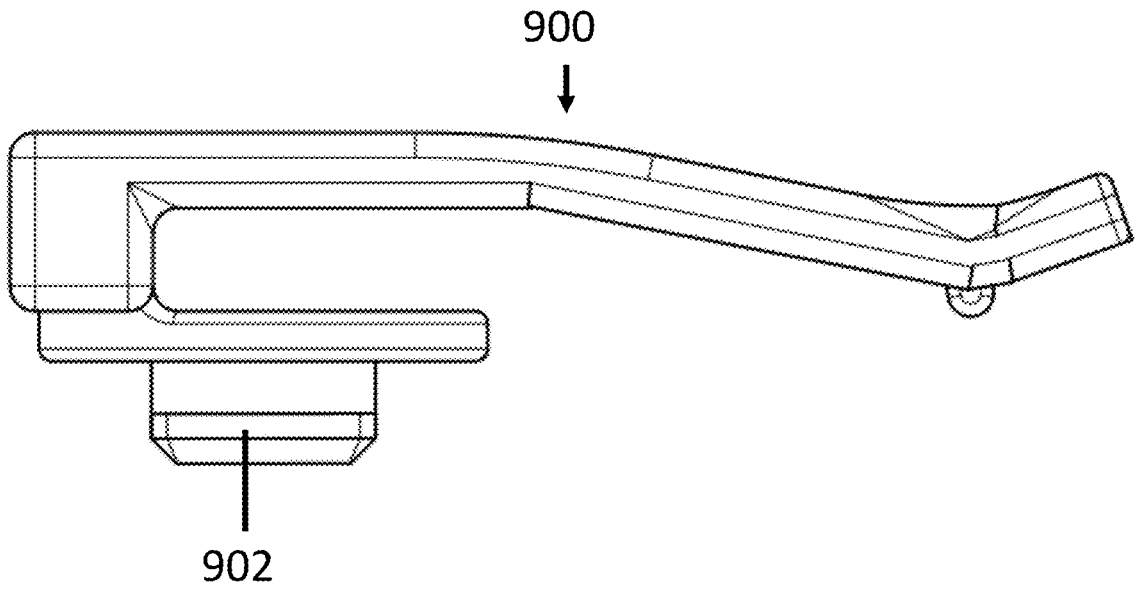
FIG. 28A illustrates a side view of the belt clip accessory.
Figure 28B:
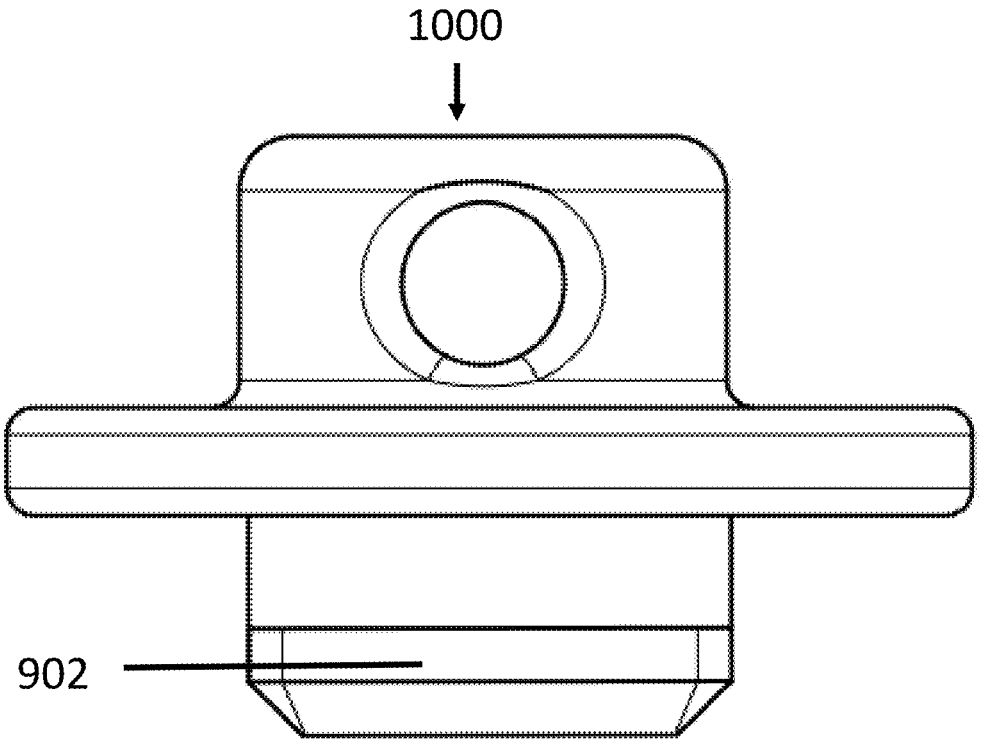
FIG. 28B illustrates a side view of the key loop accessory.
Figure 28C:
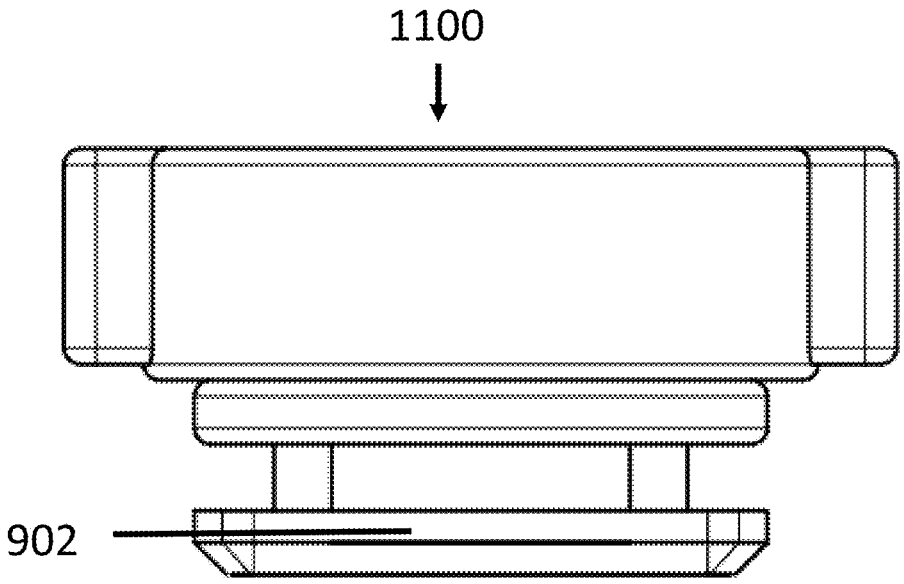
FIG. 28C illustrates a side view of the magnet accessory.
Figure 28D:
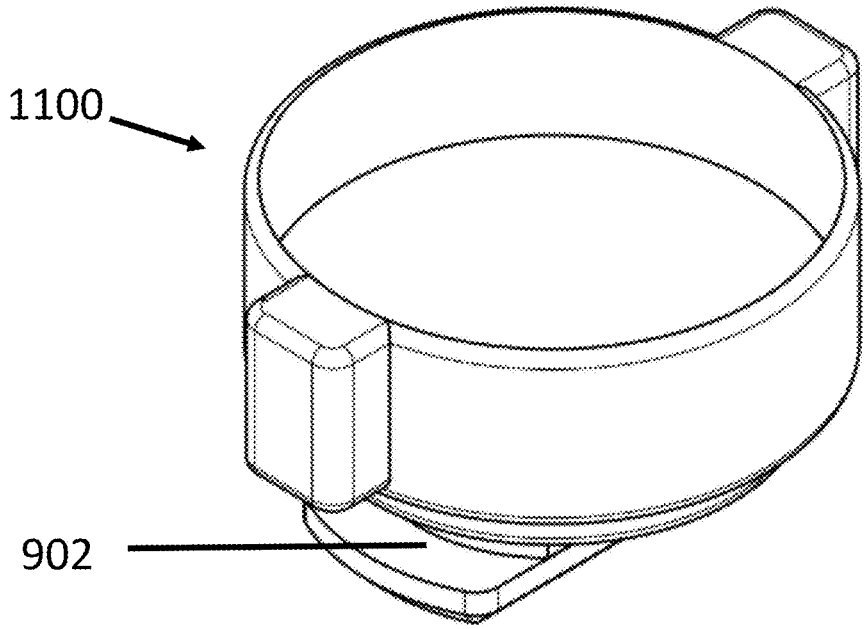
FIG. 28D illustrates a perspective view of the magnet accessory.
Figure 28E:
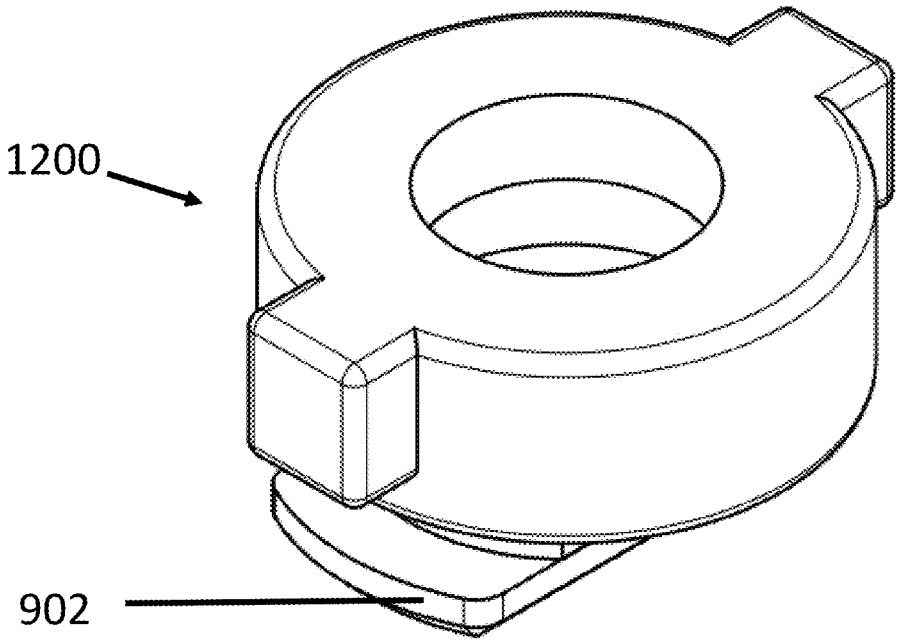
FIG. 28E illustrates a perspective view of the suction cup accessory.

FIGS. 25-26 illustrate side and perspective views of the pin 600 of the nicotine pouch dispenser, respectively. In one embodiment, the pin 600 is operable to be cylindrical in shape with a larger head on one end of the pin 600 to stop the pin when the pin is fully in place. In one embodiment, the pin 600 is comprised of materials such as plastic, metal, and/or fiber-reinforced composite. Preferably, the materials used provide a high strength-to-weight ratio for increased durability. In one embodiment, the material used for the pin 600 includes a food-safe grade plastic, including but not limited to: ABS (Acrylonitrile Butadiene Styrene), Polycarbonate, Polypropylene, HDPE (High-Density Polyethylene), PET (Polyethylene Terephthalate), PP (Polypropylene), POM (Polyoxymethylene, Acetal). In another embodiment, the material used for the body 200 includes a food-safe grade metal, including but not limited to, carbon steel (e.g., AH36, DH36, EH36, etc.), alloy steel (e.g., of grades MD, ME, MF, MG, etc.), stainless steel (e.g., grades 316, 304, etc.), galvanized steel, aluminum (e.g., grades 5052, 5083, etc.), copper (e.g., C70600, C71500, etc.), brass (e.g., C46200, C46400, C48500, etc.), titanium, and bronze (e.g., C65500, C95400, C51000, etc.). In one embodiment, the pin 600 is formed by injection molding.

Pouch Dispenser Holster

FIGS. 27A-G illustrate different views of the nicotine pouch dispenser holster 800. In one embodiment, the holster 800 fits around the body of the pouch dispenser. In one embodiment, the holster 800 is rectangularly prismatic with filleted edges. The inside dimension of the holster 800 is substantially similar to the size and shape of the outside of the body of the pouch dispenser to provide a snug fit between the pouch dispenser and the holster 800. In one embodiment, the interior walls of the holster 800 are textured and/or has a slightly rough surface to provide a firm grip on the dispenser. In one embodiment, the inside of the holster 800 includes a notch 806 and/or indent on the inside of the front face to grip the lower body section of the nicotine pouch dispenser or to otherwise grip the outer walls of the nicotine pouch dispenser, such that the dispenser does not come out unintentionally. In one embodiment, the holster 800 has a cutout 804 on the top of the front and back side of the holster 800. The cutouts 804 allow the lip of the lid and the body hinges of the nicotine pouch dispenser to slide into the holster 800 without interference while also allowing the lid to still open and close as intended. The holster 800 features a quick connect system with the female coupling component 802 integrated into the body of the holster 800. The quick connect system allows the user to insert a male coupling component on an attachment to the holster 800 into the female coupling component 802 in the body of the holster 800 and rotate the attachment roughly 90 degrees around the quick connect axis to lock the attachment into place. The attachment is removed by reversing the previous steps: twisting the attachment 90 degrees and pulling the attachment away from the holster 800 to disconnect the attachment from the holster 800. The quick connect system allows for a secure and easy change from one attachment to another.

In another embodiment, the quick connect system is configured to feature a 180, 270, and/or 360-degree turn connection system. In an alternative embodiment, the quick connect system uses a magnetic latch system that allows the quick attaching and locking of an attachment onto the holster 800. In another embodiment, the quick connect system features a slide-lock mechanism, where the female coupling component 802 is integrated into the body of the holster 800. The male coupling component on the attachment slides into the female receiver along a guided track until it reaches a locking position. A spring-loaded latch secures the attachment in place. The attachment is removed by disengaging the latch and sliding the attachment out of the female receiver.

In another embodiment, the quick connect system is a push-to-connect mechanism. In this embodiment, the male coupling component features spring-loaded ball bearings that engage with corresponding recesses inside the female receiver when inserted. The attachment is locked in place upon full insertion. The attachment is removed by pulling it away from the holster 800 while pressing a release collar to disengage the locking mechanism.

In another embodiment, the quick connect system utilizes a snap-fit design. In this embodiment, male coupling component includes flexible locking tabs that engage with retention slots in the female receiver upon insertion. The attachment is secured in place without requiring additional user input. To remove the attachment, the user presses release tabs or squeezes the male coupling component to disengage the locking mechanism and pulls the attachment away from the holster 800.

In another embodiment, the holster 800 includes interchangeable decorative covers or skins. The covers attach via a snap-fit or slide-in mechanism, allowing users to customize the appearance of the holster 800. The covers may be made from materials such as leather, silicone, or metal, offering various logos, emblems, or designs. This embodiment allows for personalization while maintaining the functionality of the dispenser.

In one embodiment, the holster 800 is made of a flexible, stretchable material such as silicone or thermoplastic elastomer (TPE). This allows the holster 800 to accommodate slight variations in dispenser size and provide a tight, secure grip while remaining easy to remove. In another embodiment, the holster 800 is made of a food-grade plastic, including but not limited to, ABS (Acrylonitrile Butadiene Styrene), Polycarbonate, Polypropylene, HDPE (High-Density Polyethylene), PET (Polyethylene Terephthalate), PP (Polypropylene), POM (Polyoxymethylene, Acetal). In another embodiment, the material used for the holster 800 includes a food-safe grade metal, including but not limited to, carbon steel (e.g., AH36, DH36, EH36, etc.), alloy steel (e.g., of grades MD, ME, MF, MG, etc.), stainless steel (e.g., grades 316, 304, etc.), galvanized steel, aluminum (e.g., grades 5052, 5083, etc.), copper (e.g., C70600, C71500, etc.), brass (e.g., C46200, C46400, C48500, etc.), titanium, and bronze (e.g., C65500, C95400, C51000, etc.).

FIGS. 28A-E illustrate different attachments able to be attached to the holster. In one embodiment, the attachments are operable to include a belt clip 900, a key loop 1000, a magnet 1100, and/or a suction cup 1200, all including a male coupling component 902 for easy and quick connection on and off the holster.

The belt clip 900 attachment allows the holster to be securely attached to a belt, waistband, and/or pocket. The belt clip 900 is operable to be made from plastic or metal to provide a firm grip to prevent accidental detachment. The male coupling component 902 enables quick and easy attachment or removal. In another embodiment the belt clip 900 includes a locking mechanism for added security.

The key loop 1000 attachment provides a convenient way to attach the holster to keychains, carabiners, and/or lanyards. The male coupling component 902 enables quick and easy attachment or removal.

The magnet 1100 attachment enables the holster to be secured to metal surfaces such as toolboxes, vehicles, and/or desks. The magnet 1100 attachment is operable to be made from neodymium or any ferromagnetic material to provide a firm hold while allowing for quick detachment. The male coupling component 902 enables quick and easy attachment or removal.

The suction cup 1200 attachment allows the holster to adhere to smooth surfaces like glass, tile, and/or polished metal. The suction cup 1200 is operable to be made from rubber or silicone to create a strong vacuum seal for temporary attachment. The male coupling component 902 enables quick and easy attachment or removal.

In another embodiment, an attachment includes a retractable lanyard mechanism integrated into its body. The lanyard is attached to a spool with a tensioned retraction system, allowing the user to extend the dispenser while keeping it securely tethered. The lanyard locks at various lengths and retracts when released.

In one embodiment, the magnet attachment 1100 includes one or more ferromagnets, allowing the holster and the pouch dispenser to attach to any metallic surface (golf cart, toolbox, fridge, at the gym, etc.). In an alternative embodiment, the holster itself is embedded with strong neodymium magnets, allowing it to attach securely to metallic surfaces. This eliminates the need for a separate magnetic attachment while ensuring the dispenser remains easily accessible.

In one embodiment, the attachments are made of a food-grade plastic, including but not limited to, ABS (Acrylonitrile Butadiene Styrene), Polycarbonate, Polypropylene, HDPE (High-Density Polyethylene), PET (Polyethylene Terephthalate), PP (Polypropylene), POM (Polyoxymethylene, Acetal). In another embodiment, the material used for the attachments includes a food-safe grade metal, including but not limited to, carbon steel (e.g., AH36, DH36, EH36, etc.), alloy steel (e.g., of grades MD, ME, MF, MG, etc.), stainless steel (e.g., grades 316, 304, etc.), galvanized steel, aluminum (e.g., grades 5052, 5083, etc.), copper (e.g., C70600, C71500, etc.), brass (e.g., C46200, C46400, C48500, etc.), titanium, and bronze (e.g., C65500, C95400, C51000, etc.).

Figure 29A:
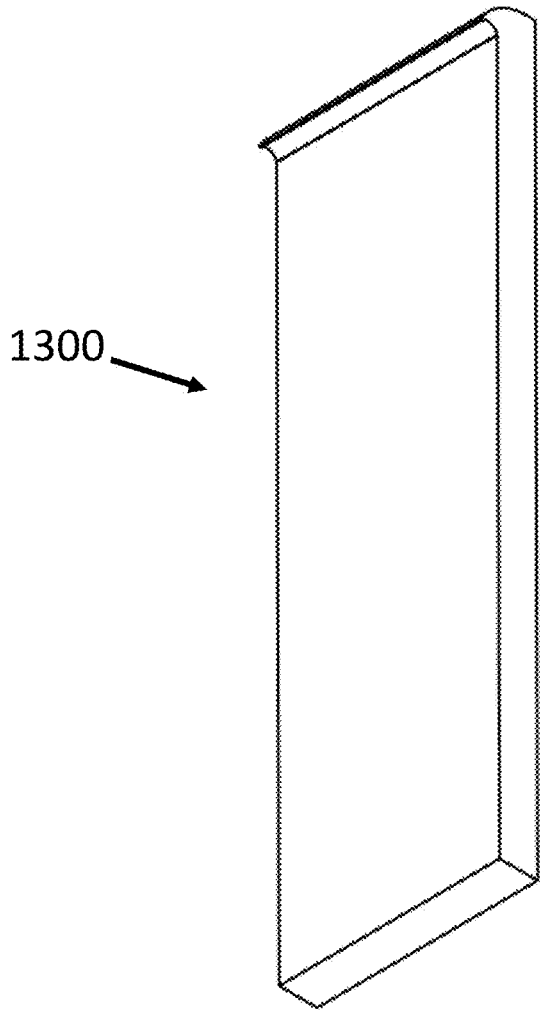
FIG. 29A illustrates a perspective view of a shim for the inner front wall of the nicotine pouch dispenser.
Figure 29B:
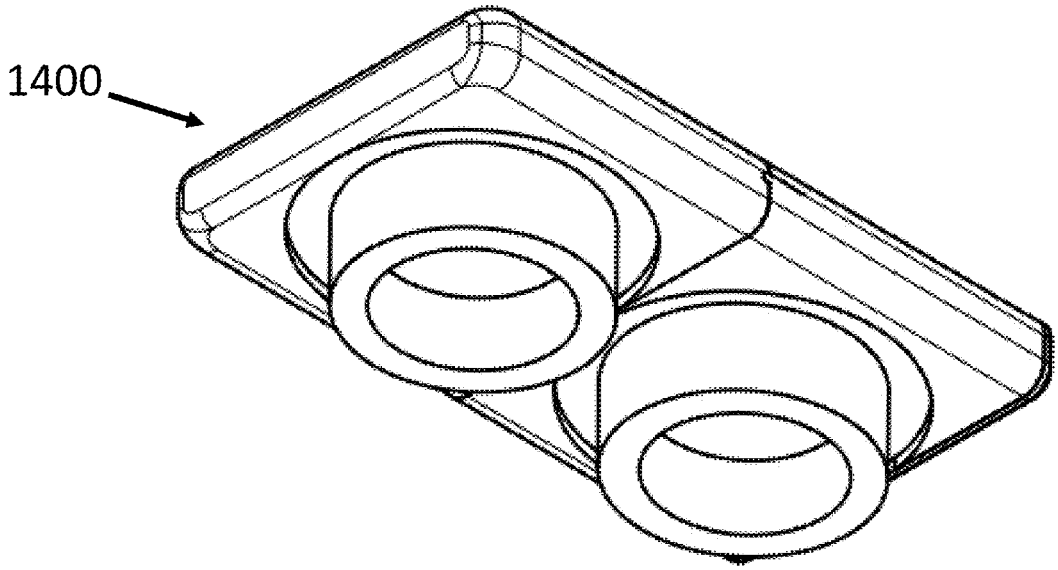
FIG. 29B illustrates a bottom perspective view of the nicotine pouch dispenser plate adjusted for the front shim.

FIG. 29A-B illustrates an alternative embodiment of the invention where a shim 1300 is inserted and attached through glue, plastic welding, double-sided tape, and/or any other similar means of attachments to the inner front wall of the body of the nicotine pouch dispenser so that the nicotine pouch dispenser is able to accommodate pouches that are shorter in length while still using the same dimensions and parts as the standard model. When the shim 1300 is implemented, a shorter nicotine pouch dispenser plate 1400 is utilized, as the original plate would not fit or slide with the shim 1300 in place. With those two modifications, the nicotine pouch dispenser accommodates a shorter nicotine pouch. One of ordinary skill in the art will understand that the shim 1300 and the shorter nicotine pouch dispenser plate 1400 are operable to be a variety of sizes to accommodate almost any length of nicotine pouch.

Figure 30A:
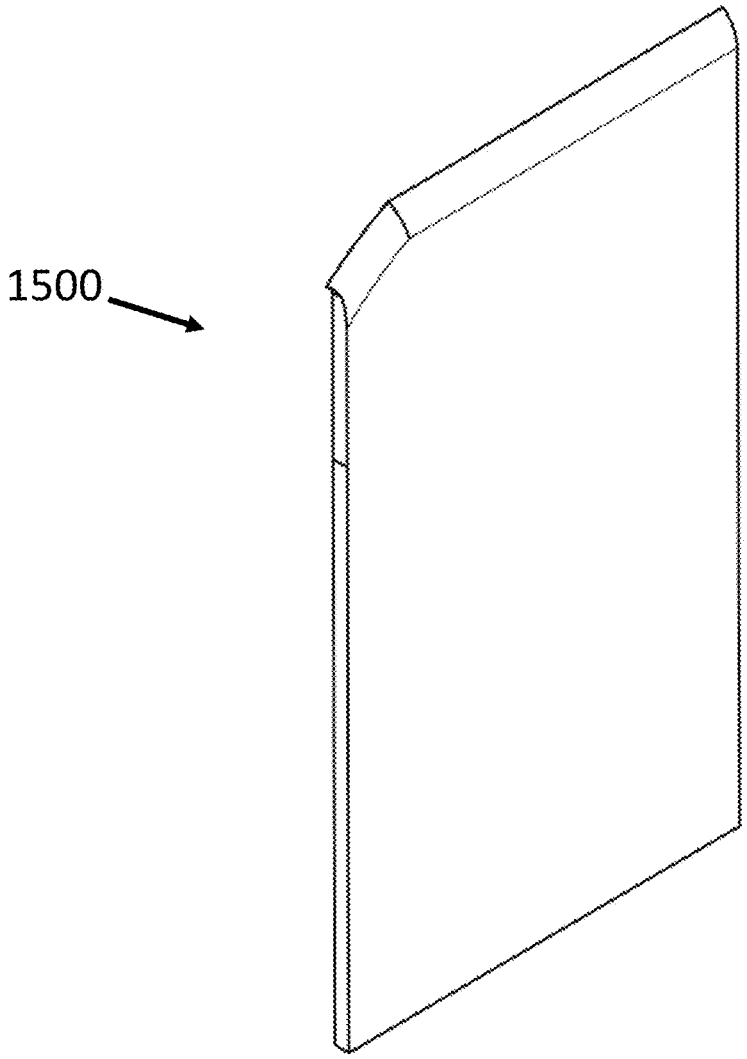
FIG. 30A illustrates a perspective view of a shim for the left and right interior walls of the nicotine pouch dispenser.
Figure 30B:
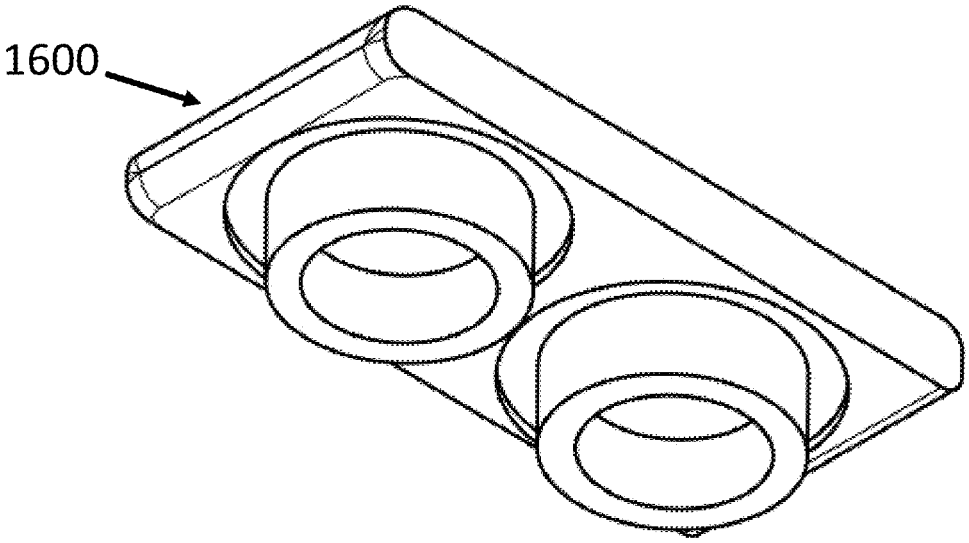
FIG. 30B illustrates a bottom perspective view of the nicotine pouch dispenser plate adjusted for the side shims.

FIG. 30A-B illustrates an alternative embodiment of the invention where a side shim 1500 and a mirrored copy are inserted and attached through glue, plastic welding, double-sided tape, and/or any other similar means of attachments to the inner left and right walls of the body of the nicotine pouch dispenser so that the nicotine pouch dispenser accommodates pouches that are skinnier in width while still using the same dimensions and parts as the standard model. In one embodiment, two side shims 1500 are utilized, with a first being attached to the inner left wall of the pouch dispenser, and a second being attached to the inner right wall of the pouch dispenser. When using the side shim 1500, a skinnier nicotine pouch dispenser plate 1600 is utilized, as the original plate would not fit or slide with side shims 1500 in place. With those two modifications, the nicotine pouch dispenser accommodates a skinnier nicotine pouch. One of ordinary skill in the art will understand that the side shims 1500 and the skinnier nicotine pouch dispenser plate 1600 are operable to be a variety of sizes to accommodate various lengths of nicotine pouch.

In one embodiment, the shim and side shims are configured to be installed together in any combination with an appropriately sized plate so that the nicotine pouch dispenser accommodates smaller pouches of various sizes. In one embodiment, the shim(s) and smaller plate is installed during manufacturing of the product based on the customer's selected size. In another embodiment, the shim(s) and smaller plate are installed by the user and are operable to be a retrofit to the existing device and are able to be taken in and out for user flexibility.

In one embodiment, the shim(s) and plate are made of a food-grade plastic, including but not limited to, ABS (Acrylonitrile Butadiene Styrene), Polycarbonate, Polypropylene, HDPE (High-Density Polyethylene), PET (Polyethylene Terephthalate), PP (Polypropylene), POM (Polyoxymethylene, Acetal). In another embodiment, the material used for the shim(s) and plate includes a food-safe grade metal, including but not limited to, carbon steel (e.g., AH36, DH36, EH36, etc.), alloy steel (e.g., of grades MD, ME, MF, MG, etc.), stainless steel (e.g., grades 316, 304, etc.), galvanized steel, aluminum (e.g., grades 5052, 5083, etc.), copper (e.g., C70600, C71500, etc.), brass (e.g., C46200, C46400, C48500, etc.), titanium, and bronze (e.g., C65500, C95400, C51000, etc.).

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A spring-loaded nicotine pouch dispenser, comprising:
a body component including a cutout on a top face of one part of the body component,
wherein the cutout includes a rear retention edge and at least one retention prong,
wherein the body component includes at least one hinge;
a plate positioned below the cutout;
a cap attached to the body component via the at least one hinge and a pin; and
at least one spring mounted between the plate and an internal surface of the body component;
wherein the spring-loaded nicotine pouch dispenser is configured to store a nicotine pouch and is further configured to dispense the nicotine pouch;
wherein the rear retention edge of the cutout is configured to retain a back edge of the nicotine pouch; and
wherein the at least one retention prong is configured to retain a front section of the nicotine pouch.

2. The spring-loaded nicotine pouch dispenser of claim 1, further comprising a bottom seal plate attached to the body component through welding, plastic welding, adhesives, screws, latches, or other permanent or semi-permanent joining process.

3. The spring-loaded nicotine pouch dispenser of claim 1, wherein at least one second hinge is mounted on a backside of the body component.

4. The spring-loaded nicotine pouch dispenser of claim 1, wherein the nicotine pouch is held between the plate and the cutout, wherein the at least one spring pushes the plate and the nicotine pouch towards the cutout.

5. The spring-loaded nicotine pouch dispenser of claim 1, wherein the spring-loaded nicotine pouch dispenser is formed of plastic, metal, and/or fiber-reinforced composite.

6. The spring-loaded nicotine pouch dispenser of claim 1, wherein the cap includes a lip protruding from a front surface of the cap.

7. The spring-loaded nicotine pouch dispenser of claim 1, wherein a bottom surface of the plate includes at least one cylindrical extension, wherein the at least one cylindrical extension retains the at least one spring in place under the plate.

8. The spring-loaded nicotine pouch dispenser of claim 1, wherein the body component is formed via injection molding.

9. A spring-loaded nicotine pouch dispenser, comprising:
a body component including a cutout on a top face of one part of the body component,
wherein the cutout includes a rear retention edge and at least one retention prong,
wherein the body component includes at least one hinge, wherein the body component further comprises a locking prong having a rectangular prism shaped protrusion acting as an interference lock;
a plate positioned below the cutout and the at least one retention prong;
a cap attached to the body component via the at least one hinge; and
at least one spring mounted between the plate and an internal surface of the body component;
wherein the spring-loaded nicotine pouch dispenser is configured to store a nicotine pouch and is further configured to dispense the nicotine pouch;
wherein the rear retention edge of the cutout is configured to retain a back edge of the nicotine pouch; and
wherein the at least one retention prong is configured to retain a front section of the nicotine pouch.

10. The spring-loaded nicotine pouch dispenser of claim 9, further comprising a bottom seal plate attached to the body component through welding, plastic welding, adhesives, screws, latches, or other permanent or semi-permanent joining process.

11. The spring-loaded nicotine pouch dispenser of claim 9, wherein at least one second hinge is mounted on a backside of the body component.

12. The spring-loaded nicotine pouch dispenser of claim 9, further comprising at least one gasket.

13. The spring-loaded nicotine pouch dispenser of claim 9, wherein the cap includes a lip protruding from a front surface of the cap.

14. The spring-loaded nicotine pouch dispenser of claim 9, wherein a bottom surface of the plate includes at least one cylindrical extension, wherein the at least one cylindrical extension retains the at least one spring in place under the plate.

15. The spring-loaded nicotine pouch dispenser of claim 9, wherein the body component and the plate of the spring-loaded nicotine pouch dispenser are formed via injection molding.

16. The spring-loaded nicotine pouch dispenser of claim 9, wherein at least one side of the body component includes a logo.

17. A spring-loaded nicotine pouch dispenser, comprising:
a body component including a cutout on a top face of one part of the body component,
wherein the cutout includes a rear retention edge and at least one retention prong,
wherein the body component includes at least one hinge, wherein a front face of the body component comprises a locking prong having a rectangular prism shaped protrusion acting as an interference lock;
a plate positioned below the cutout;
a cap attached to the body component via the at least one hinge; and
at least one spring mounted between the plate and an internal surface of the body component;
wherein the spring-loaded nicotine pouch dispenser is configured to store a nicotine pouch and is further configured to dispense the nicotine pouch;
wherein the cap and the body component are configured to include corresponding magnets that hold the cap closed;
wherein the rear retention edge of the cutout is configured to retain a back edge of the nicotine pouch; and
wherein the at least one retention prong is configured to retain a front section of the nicotine pouch.

18. The spring-loaded nicotine pouch dispenser of claim 17, further comprising at least one gasket.

19. The spring-loaded nicotine pouch dispenser of claim 17, wherein the plate includes at least one cylindrical extension on a bottom surface of the plate, wherein the at least one cylindrical extension retains the at least one spring in place.

20. The spring-loaded nicotine pouch dispenser of claim 17, wherein at least one side of the body component includes a logo.

* * * * *